US012035781B2

(12) United States Patent
Bell et al.

(10) Patent No.: US 12,035,781 B2
(45) Date of Patent: Jul. 16, 2024

(54) ARTICLE OF FOOTWEAR HAVING AN UPPER WITH SEPARATELY SECURING MEDIAL AND LATERAL SIDE PORTIONS

(71) Applicant: NIKE, Inc., Beaverton, OR (US)

(72) Inventors: Thomas G. Bell, Portland, OR (US); Paul J. Francis, Beaverton, OR (US); Claudio Innocente, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/946,687

(22) Filed: Sep. 16, 2022

(65) Prior Publication Data

US 2023/0011412 A1 Jan. 12, 2023

Related U.S. Application Data

(60) Continuation of application No. 15/931,700, filed on May 14, 2020, now Pat. No. 11,478,044, which is a division of application No. 15/575,694, filed as application No. PCT/US2016/034327 on May 26, 2016, now Pat. No. 10,716,356.

(60) Provisional application No. 62/167,928, filed on May 29, 2015, provisional application No. 62/167,927, filed on May 29, 2015.

(51) Int. Cl.

| | |
|---|---|
| ***A43B 13/36*** | (2006.01) |
| ***A43B 1/00*** | (2006.01) |
| ***A43B 3/06*** | (2006.01) |
| ***A43B 3/12*** | (2006.01) |
| ***A43B 11/00*** | (2006.01) |
| ***A43C 11/14*** | (2006.01) |

(52) U.S. Cl.

CPC ..... *A43B 13/36* (2013.01); *A43B 1/0081* (2013.01); *A43B 3/06* (2013.01); *A43B 3/126* (2013.01); *A43B 11/00* (2013.01); *A43C 11/1493* (2013.01)

(58) Field of Classification Search

None

See application file for complete search history.

(56) References Cited

U.S. PATENT DOCUMENTS 3,834,377 A * 9/1974 Lebold ..... A61F 5/14 36/89
4,414,759 A * 11/1983 Morgan ..... A43B 7/00 36/110
4,476,639 A * 10/1984 Zaccaria ..... A43C 11/1493 36/114

(Continued)

*Primary Examiner* — Jila M Mohandesi

(74) *Attorney, Agent, or Firm* — Quinn IP Law

(57) ABSTRACT

An article of footwear comprises a sole, and an upper that has a medial side portion extending from the medial side of the sole with a first distal end remote from the medial side. The upper has a lateral side portion extending from the lateral side of the sole with a second distal end remote from the lateral side. The upper may include a support member extending at least partially across the foot-receiving surface with a first end remote from the medial side. The medial and lateral side portions wrap at least partially around a foot with the first distal end securable proximal to the lateral side, and the second distal end separately securable proximal to the medial side. An article of footwear has cables with proximal ends fixed to one side of the upper and that extend through looped cables on an opposite side of the upper.

19 Claims, 13 Drawing Sheets

(56) References Cited

U.S. PATENT DOCUMENTS

| | | | | |
|---|---|---|---|---|
| 5,014,448 | A * | 5/1991 | Perrone | A61F 5/0195 36/110 |
| 6,212,798 | B1 * | 4/2001 | Koenig | A61F 5/0195 36/110 |
| 2010/0154256 | A1 * | 6/2010 | Dua | A43B 1/04 12/146 B |

* cited by examiner

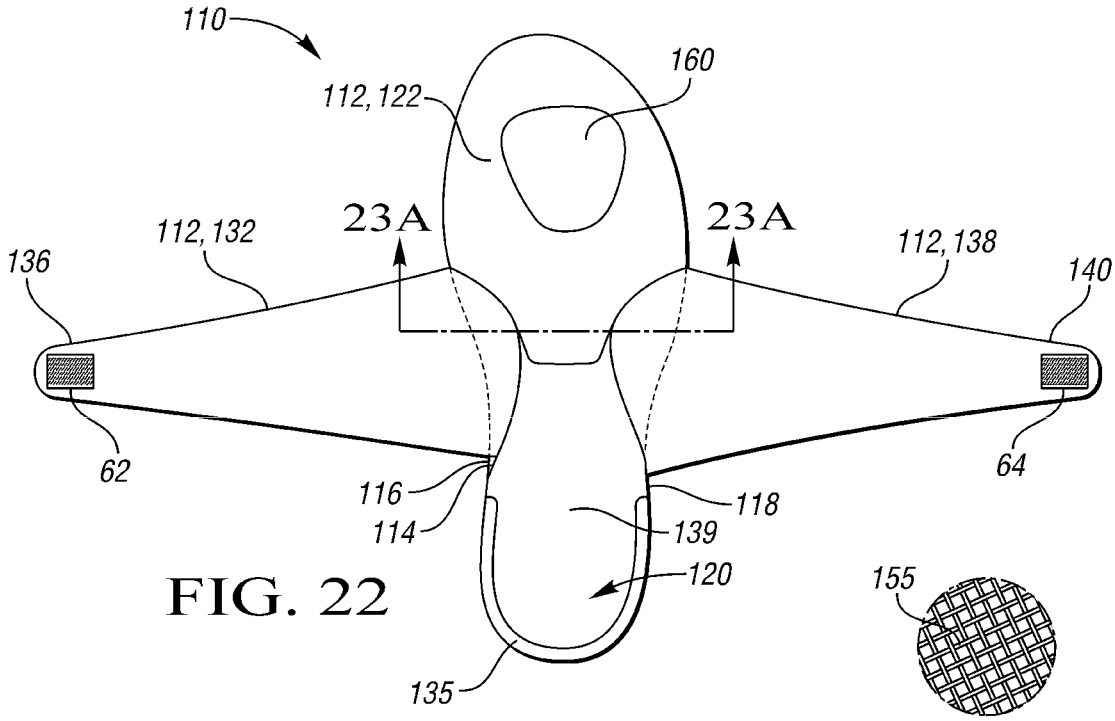
FIG. 22
FIG. 23B
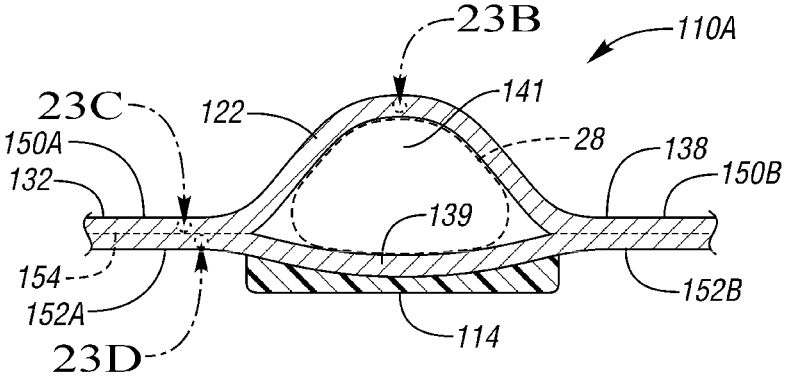
FIG. 23A
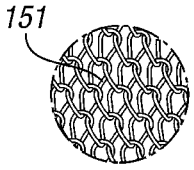
FIG. 23C
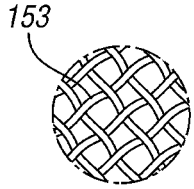
FIG. 23D
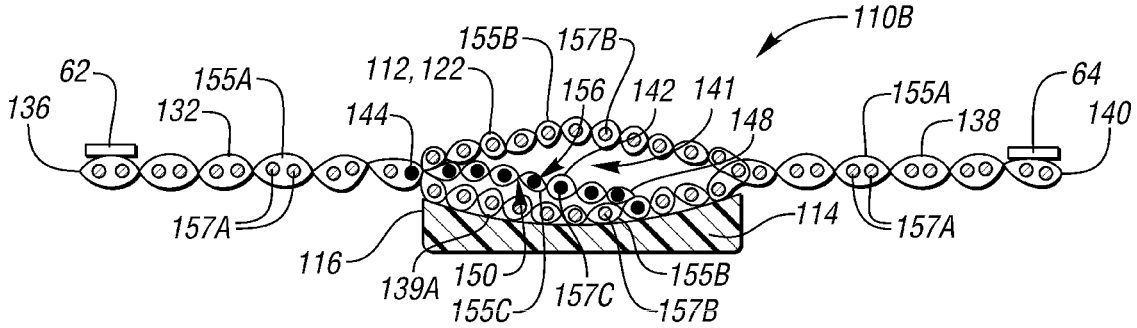
FIG. 24

ARTICLE OF FOOTWEAR HAVING AN UPPER WITH SEPARATELY SECURING MEDIAL AND LATERAL SIDE PORTIONS

CROSS-REFERENCE TO RELATED APPLICATIONS

This application is continuation of U.S. application Ser. No. 15/931,700, filed May 14, 2020, which is a divisional of U.S. application Ser. No. 15/575,694, filed Nov. 20, 2017, now issued as U.S. Pat. No. 10,716,356, issued Jul. 21, 2020, which is the national stage of International Application No. PCT/US2016/034327 filed May 26, 2016, which claims priority to and the benefit of United Stated Provisional Application No. 62/167,927, filed May 29, 2015 and United Stated Provisional Application No. 62/167,928, filed May 29, 2015, each of which is incorporated by reference in its entirety.

TECHNICAL FIELD

The present teachings generally relate to an article of footwear having an upper.

BACKGROUND

Footwear typically includes a sole configured to be located under a wearer's foot to space the foot away from the ground or floor surface. Sole structure can be designed to provide a desired level of cushioning. Athletic footwear in particular sometimes utilizes polyurethane foam or other resilient materials in the sole structure to provide cushioning. It is also beneficial for the sole structure for an article of athletic footwear to have a ground contact surface that provides sufficient traction and durability for a particular athletic endeavor. An upper attached to the sole structure typically surrounds the sides and top of the foot, and often includes a lacing system, a buckle, or other fastening system to tighten the upper around the foot.

BRIEF DESCRIPTION OF THE DRAWINGS

FIG. 22 is a schematic illustration in plan view of an eighth embodiment of an article of footwear.

FIG. 23A is a schematic cross-sectional illustration taken at lines 23A-23A in FIG. 22 of the article of footwear of FIG. 22.

FIG. 23B is a close-up plan view of a front portion of the article of footwear of FIG. 23A.

FIG. 23C is a close-up plan view of a layer of a medial side portion of the article of footwear of FIG. 23A.

FIG. 23D is a close-up plan view of another layer of the medial side portion of the article of footwear of FIG. 23A.

FIG. 24 is a schematic cross-sectional illustration of a ninth embodiment of an article of footwear.

DESCRIPTION

Figure 1:
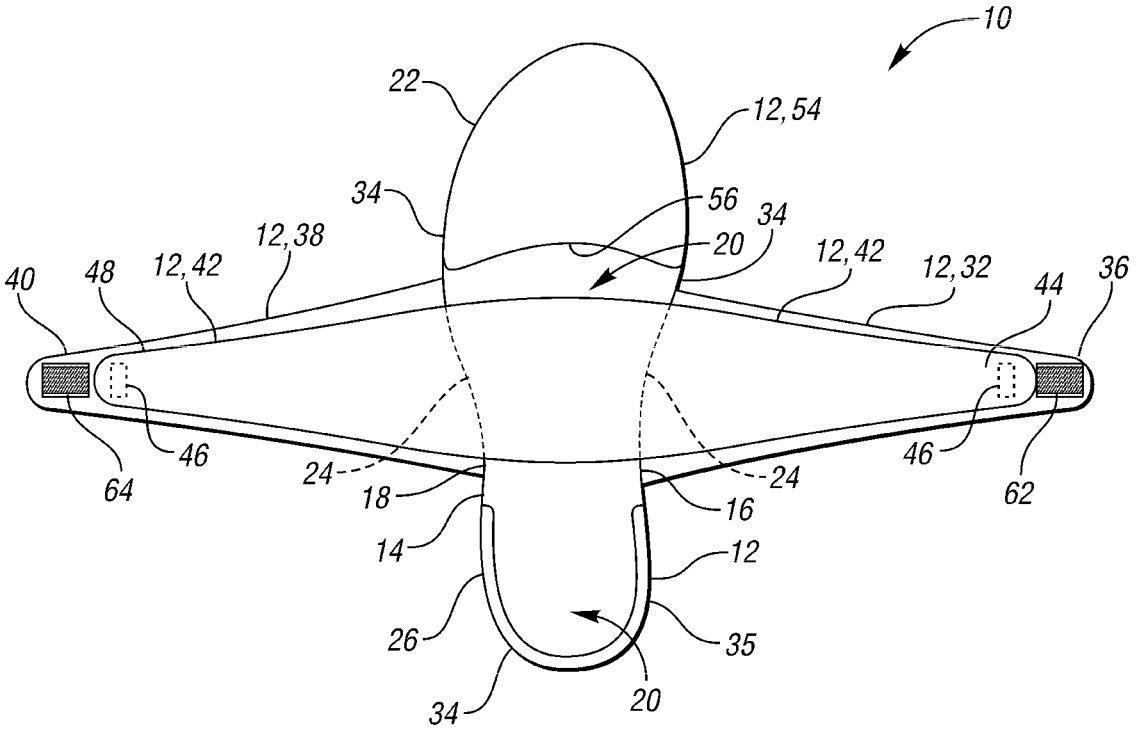
FIG. 1 is a schematic illustration in plan view of a first embodiment of an article of footwear showing extended upper portions.

An article of footwear is provided that enables an adjustable fit, with a particular ability to provide lifting support to the medial midfoot, such as in the area of the navicular joint. More specifically, the article of footwear includes a sole having a medial side, a lateral side, and a foot-receiving surface. The article of footwear also includes an upper that has a medial side portion, a lateral side portion, and a support member. The medial side portion extends from the medial side of the sole and has a first distal end remote from the medial side. The lateral side portion extends from the lateral side of the sole and has a second distal end remote from the lateral side. The support member extends at least partially across the foot-receiving surface and has a first end remote from the medial side of the sole. In some embodiments, the first end of the support member is fixed to the medial side portion. In other embodiments, the first end of the support member is not fixed to the medial side portion and is thus securable to the upper separately from the medial side portion. The medial side portion and the lateral side portion are configured to wrap at least partially around a foot positioned on the foot-receiving surface and on the support member. The first distal end is then securable to the article of footwear proximal to the lateral side, and the second distal end is separately securable to the article of footwear proximal to the medial side. As used herein, "proximal" means on, about, near, by, next to, adjacent, and the like. In contrast, as used herein, "distal" means spaced apart from, away from, and the like.

For example, the medial side portion may wrap over the foot toward the lateral side, and the lateral side portion may wrap over the foot and toward the medial side. An outer surface of the support member may face an inner surface of the medial side portion.

In an embodiment, the support member has a second end fixed to the sole between the medial side and the lateral side. For example, the support member may be fixed only at the first end and the second end. In such an embodiment, the support member may taper in width from the second end to the first end.

In another embodiment, the support member has a second end fixed to the lateral side portion such that the support member spans across the sole without connection to the sole. In other words, the support member is fixed only at the first end and the second end. The medial side portion may taper in width from the medial side of the sole to the first distal end, and the lateral side portion may taper in width from the lateral side of the sole to the second distal end so that the support member is wider over the foot-receiving surface than at either the first end or the second end In an embodiment, the sole has a forefoot portion, a heel portion, and a midfoot portion extending from the forefoot portion to the heel portion. The medial side portion may extend from the medial side only at the midfoot portion, and the lateral side portion may extend from the lateral side only at the midfoot portion.

Additionally, the medial side portion may have a first elasticity, and the support member may have a second elasticity different from the first elasticity. Configuring the support member with a different elasticity than the medial side portion can affect the flexibility and support provided by the support member at the midfoot portion.

In an embodiment, the lateral side portion includes a first strap extending from the lateral side, and a second strap extending from the lateral side rearward of the first strap. Providing multiple straps on the lateral side further allows for a customizable and adjustable fit when the first and second straps are selectively secured to the article of footwear separately from the medial side portion.

The article of footwear may include any of various fastening systems that secure the medial and lateral side portions to the article of footwear. In one embodiment, a fastening system includes a first fastener portion fixed to the first distal end, a second fastener portion fixed to the second distal end, and a third fastener portion fixed to a heel member that extends from a heel portion of the sole. The first, second, and third fastener portions may be referred to as first, second, and third fasteners. The first fastener portion and the second fastener portion are securable to the third fastener portion when the medial side portion and the lateral side portion are wrapped at least partially around the foot.

For example, the fastening system may be a hook-and-loop fastening system in which the first fastener portion and the second fastener portion are both either a plurality of hooks or a plurality of loops securable to a plurality of hooks. The third fastener portion is the other of the plurality of hooks or the plurality of loops. Optionally, each of the plurality of hooks can include a stem with a double-pronged end. Additionally, in one embodiment, the first fastener portion and the second fastener portion are inner fastener portions on inner surfaces of the medial side portion and the lateral side portion, respectively. The fastening system further includes outer fastener portions fixed to outer surfaces of the medial side portion and the lateral side portion, respectively. The article of footwear includes a cover fixed to the heel member. The cover has flap portions that at least partially lay over the first distal end and the second distal end when the first fastener portion and the second fastener portion are secured to the third fastener portion. The fastening system includes additional fastener portions that are fixed to the flap portions and are securable to the outer fastener portions when the medial side portion and the lateral side portion are wrapped at least partially around the foot.

In another embodiment, a fastening system included in the article of footwear can be a mechanical interlocking fastening system, such as a fastening system in which the third fastener portion has multiple spaced protrusions. The first fastener portion or the second fastener portion is securable to the third fastener portion at any selected one of multiple spaced protrusions when the medial side portion and the lateral side portion are wrapped at least partially around the foot. The other one of the first fastener portion and the second fastener portion may be securable to a different one of the multiple spaced protrusions of the third fastener portion, or another fastener portion similar to the third fastener portion with multiple spaced protrusions may be provided for the other one of the first fastener portion and the second fastener portion to secure to.

In another embodiment of a mechanical fastening system, the first, second, and third fastener portions are each a plurality of spaced stems that have enlarged ends. The enlarged ends of the first and the second fastener portions interlock with the enlarged ends of the third fastener portion when pushed against the third fastener portion.

In another embodiment, the fastening system can be a magnetic fastening system in which the first, second, and third fastening portions are a permanently magnetizable material, magnetized with rows of alternating poles so that the first and second fastening portions magnetically secure to the third fastening portion. Additionally, the first, second, and third fastening portions can have uniformly spaced protuberances and indentations. The first fastener portion and the second fastener portion will be magnetically held to the third fastener portion when placed against the third fastener portion with the protuberances of the first and second fastener portions nested in the indentations of the third fastener portions. Other alternative embodiments of magnetic fastening systems may optionally be used.

Another embodiment of a fastening system includes a first fastener portion fixed to the first distal end, a second fastener portion fixed to the second distal end, and an additional fastener portion fixed to a ground-contact surface of the sole at the heel portion. The first fastener portion and the second fastener portion are securable to the additional fastener portion when the medial side portion and the lateral side portion are wrapped at least partially around the foot.

In an embodiment, an article of footwear includes a sole having a medial side, a lateral side, and a foot-receiving surface. The foot-receiving surface has a forefoot portion, a heel portion, and a midfoot portion extending from the forefoot portion to the heel portion between the lateral side and the medial side. The article of footwear includes an upper having a medial side portion extending from the medial side of the sole and tapering in width to a first distal end, a lateral side portion extending from the lateral side of the sole and tapering in width to a second distal end, and a support member extending laterally at least partially across the foot-receiving surface at the midfoot portion. The support member has a first end fixed to the medial side portion. The medial side portion and the lateral side portion are configured to wrap at least partially around a wearer's foot positioned on the foot-receiving surface and on the support member. A heel member extends from the heel portion of the sole. A fastening system is configured such that the first distal end is securable to the heel member posterior to the lateral side portion, and the second distal end is separately securable to the heel member posterior to the medial side portion when the medial side portion and the lateral side portion are wrapped at least partially around the foot. Optionally, the support member may have a second end fixed to the midfoot portion of the sole between the medial side and the lateral side, and may be fixed only at the first end and the second end. Alternatively, the support member may have a second end fixed to the lateral side portion such that the support member spans across the sole and is fixed at only the first end and the second end without connection to the sole. In either embodiment, the medial side portion may have a first elasticity, and the support member may have a second elasticity different from the first elasticity.

In an embodiment, the upper further includes a front portion extending between the medial side portion and the lateral side portion. The article of footwear further comprises a strobel portion extending between the medial side portion and the lateral side portion. The medial side portion, the lateral side portion, the support member, the front portion, and the strobel portion define a pocket configured to receive the foot and are integrally formed as a contiguous, unitary component by at least one of knitting, weaving, and braiding. Stated differently, no stitching is necessary to secure the medial side portion, the lateral side portion, the support member, the front portion, and the strobel portion to one another.

An article of footwear includes a sole having a medial side, a lateral side, and a foot-receiving surface. The article of footwear further includes a strobel portion, and an upper having a medial side portion, a lateral side portion, and a front portion. The medial side portion extends from the medial side of the sole and has a first distal end remote from the medial side. The lateral side portion extends from the lateral side of the sole and has a second distal end remote from the lateral side. The front portion extends between the medial side portion and the lateral side portion. The strobel portion extends between the medial side portion and the lateral side portion. The medial side portion, the lateral side portion, the front portion, and the strobel portion define a pocket configured to receive the foot and are integrally formed as a contiguous, unitary component by at least one of knitting, weaving, and braiding. The medial side portion and the lateral side portion are configured to wrap at least partially around a foot positioned on the foot-receiving surface. The first distal end is securable to the article of footwear proximal to the lateral side, and the second distal end is separately securable to the article of footwear proximal to the medial side when the medial side portion and the lateral side portion are wrapped at least partially around the foot.

Optionally, the article of footwear further includes a support member that extends at least partially across the foot-receiving surface and has a first end fixed to the medial side portion remote from the medial side of the sole. The support member is integrally formed with the medial side portion, the lateral side portion, the front portion, and the strobel portion by at least one of knitting, weaving, and braiding. The upper may include a heel member extending from the sole at the heel portion of the sole.

Optionally, the article of footwear includes a fastening system that has a first fastener portion fixed to the first distal end, a second fastener portion fixed to the second distal end, and a third fastener portion fixed to the heel member. The first fastener portion and the second fastener portion are securable to the third fastener portion when the medial side portion and the lateral side portion are wrapped at least partially around the foot.

Within the scope of the present teachings, an article of footwear comprises an upper having a medial side and a lateral side. The article of footwear includes a plurality of first cables each having a proximal end and a distal end. The proximal end is fixed to one of the medial side or the lateral side of the upper. A first fastener portion is secured to the distal end of each one of the plurality of first cables and is fastenable to the upper. A plurality of first looped cables extend in an array on an opposite one of the medial side or the lateral side of the upper. Each of the plurality of first cables extends through a different respective one of the plurality of first looped cables between the proximal end and the distal end. The plurality of first cables extends along the one of the medial side or the lateral side of the upper between the plurality of first looped cables and the first fastener fastened to the upper.

The article of footwear may further comprise a plurality of second cables each of which has a proximal end fixed to an opposite one of the medial side or the lateral side of the upper, and a distal end. In other words, the proximal end of each second cable is fixed to the opposite side of the upper than the proximal end of each first cable. A second fastener portion is secured to the distal end of each one of the plurality of second cables and is fastenable to the upper. A plurality of second looped cables extend in an array on the one of the medial side or the lateral side of the upper (i.e., on the same side of the upper to which the proximal end of each first cable is fixed). Each of the plurality of second cables extends through a different respective one of the plurality of second looped cables between the proximal end and the distal end. The plurality of second cables extends along the opposite one of the medial side or the lateral side of the upper between the plurality of second looped cables and the second fastener fastened to the upper.

Optionally, the one of the medial side or the lateral side of the upper may define elongated first channels each of which encloses a different respective one of the plurality of first cables from the proximal end partway to the plurality of first looped cables.

Similarly, the opposite one of the medial side or the lateral side of the upper defines elongated second channels each enclosing a different respective one of the plurality of second cables from the proximal end partway to the plurality of second looped cables.

In one embodiment, the plurality of first looped cables is on the lateral side of the upper, and the proximal end of each one of the plurality of second cables is fixed to the lateral side of the upper forward of the plurality of first looped cables.

In one embodiment, the plurality of second looped cables is on the medial side of the upper, and the proximal end of each one of the plurality of first cables is fixed to the medial side of the upper rearward of the plurality of second looped cables.

Optionally, the first and second looped cables may be partially housed within channels of the upper. For example, in an embodiment, the lateral side of the upper defines elongated third channels, and the first looped cables extend from the third channels. The medial side of the upper defines elongated fourth channels, and the second looped cables extend from the fourth channels.

A heel fastener portion may be secured to a heel portion of the upper, and the first fastener portion may fasten to the heel fastener portion.

The above features and advantages and other features and advantages of the present teachings are readily apparent from the following detailed description of the modes for carrying out the present teachings when taken in connection with the accompanying drawings.

"A," "an," "the," "at least one," and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range. All references referred to are incorporated herein in their entirety.

The terms "comprising," "including," and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of" is understood to include any possible combination of referenced items, including "any one of" the referenced items. The term "any of" is understood to include any possible combination of referenced claims of the appended claims, including "any one of" the referenced claims.

Those having ordinary skill in the art will recognize that terms such as "above," "below," "upward," "downward," "top," "bottom," etc., are used descriptively relative to the figures, and do not represent limitations on the scope of the invention, as defined by the claims.

Referring to the drawings, wherein like reference numbers refer to like or identical components, FIG. 1 illustrates an article of footwear 10 in a schematic plan view. The article of footwear 10 includes an upper 12 that includes discreet, separately securing portions that enable the upper 12 to swaddle the foot, and provide adjustable lift and support to a midfoot portion of the foot. The article of footwear 10 includes a sole 14 to which the upper 12 is secured. The sole 14 has a medial side 16, a lateral side 18, and a foot-receiving surface 20. The foot-receiving surface 20 generally faces upward and extends over a forefoot portion 22, a midfoot portion 24, and a heel portion 26 of the sole 14. The heel portion 26 generally corresponds with rear portions of a human wearer's foot 28 (shown in phantom in FIGS. 5 and 6), including the calcaneus bone, with the foot 28 corresponding to the size of the article of footwear 10. The forefoot portion 22 generally includes portions of the article of footwear 10 corresponding with the toes and the joints connecting the metatarsals with the phalanges of the foot 28. The midfoot portion 24 generally corresponds with an arch area of the foot 28, and extends from the forefoot portion 22 to the heel portion 26. As shown in FIG. 1, the article of footwear 10 is for a left foot. A pair of footwear includes the article of footwear 10, and an article of footwear for a right foot that is a mirror image of the article of footwear 10.

Figure 5:
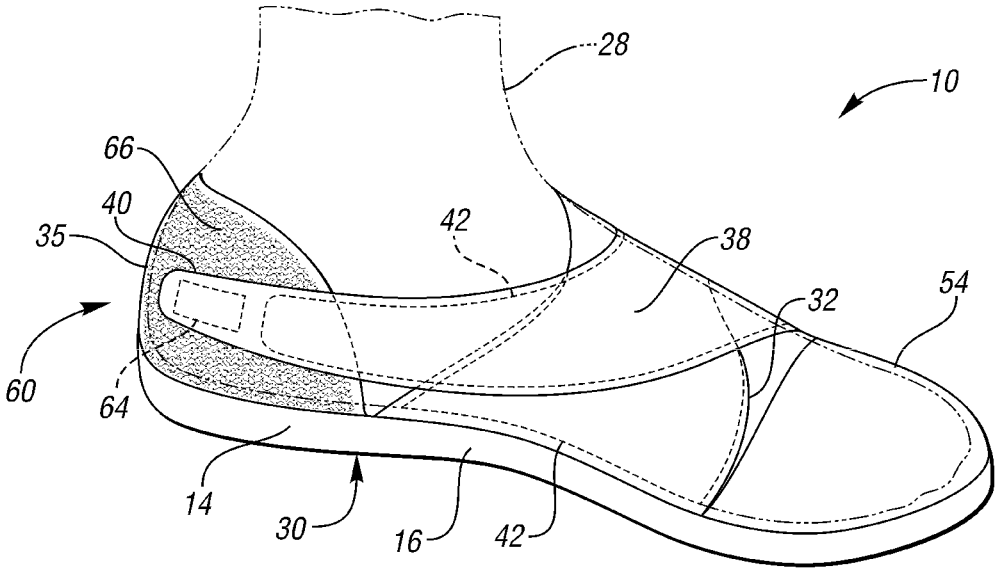
FIG. 5 is a schematic illustration in perspective view of the medial side of the article of footwear of FIG. 1 with a first embodiment of a fastening system.
Figure 6:
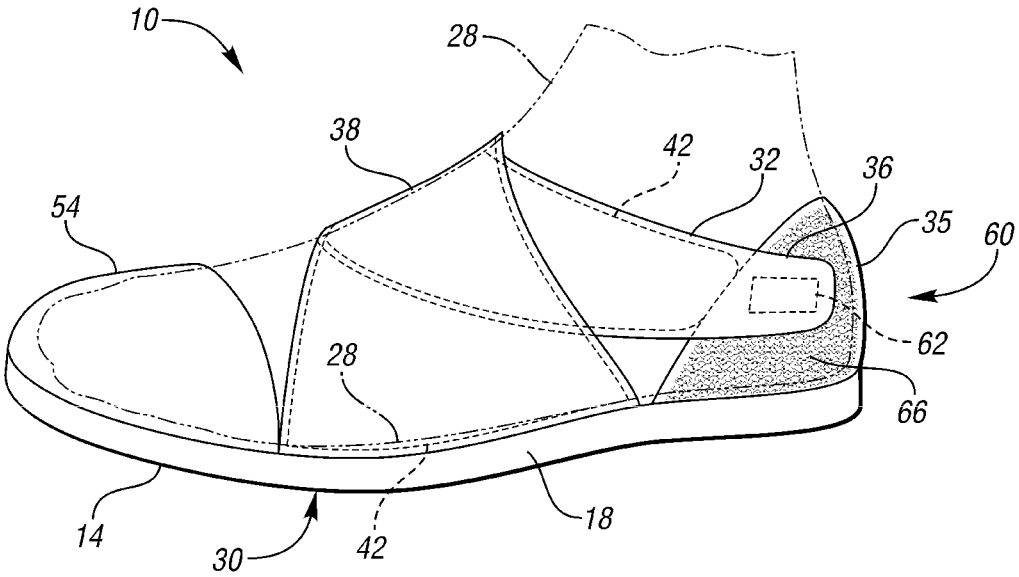
FIG. 6 is a schematic illustration in perspective view of the lateral side of the article of footwear of FIG. 1.

An opposite side of the sole 14, indicated in FIGS. 5 and 6, serves as a ground-contact surface 30 of the article of footwear 10. As shown, the article of footwear 10 is an athletic shoe, such as for track and field. The sole 14 may include any or all of an outsole, a midsole, and one or more fluid-filled or foam cushioning elements. The sole 14 may be equipped with spikes, cleats, or other ground-engaging members. In other embodiments, the article of footwear 10 could be for another category of footwear, such as a dress shoe, a work shoe, a sandal, a slipper, or a boot.

The upper 12 includes a medial side portion 32 that extends from and is fixed to the periphery 34 of the sole 14 at the medial side 16 of the sole 14. The medial side portion 32 extends to a first distal end 36 that is remote from the medial side 16. In the embodiment of FIG. 1, the medial side portion 32 is fixed to the medial side 16 only at the midfoot portion 24.

Similarly, the upper 12 has a lateral side portion 38 that extends from and is fixed to the lateral side 18 of the sole 14. The lateral side portion 38 extends to a second distal end 40 that is remote from the lateral side 18. The lateral side portion 38 is fixed to the lateral side 18 only at the midfoot portion 24.

As used herein, an "end" generally refers to an extremity of a component, and is not limited to but includes the absolute extremity of the component such as the terminal end of a component. As used herein, a "proximal end" or a "distal end" of a component is not exclusively the terminal end of the component, and can instead be a portion of the component that includes the terminal end. The first distal end 36 and the second distal end 40 may be referred to as "free" ends as they are unfixed and freely movable relative to the sole 14, except when they are selectively secured to the article of footwear 10 as described herein.

The upper 12 further includes a support member 42 that extends at least partially across the foot-receiving surface 20 of the sole 14. The support member 42 has a first end 44 fixed to the medial side portion 32 remote from the medial side 16 of the sole 14. In the embodiment shown, the first end 44 of the support member 42 is fixed to the medial side portion 32 near the first distal end 36 of the medial side portion 32 by stitching 46. Alternatively, the first end 44 of the support member 42 could be fixed to the medial side portion 32 at another point remote from the medial side 16 of the sole 14, such as midway to the first distal end 36 of the medial side portion 32.

Figure 2:
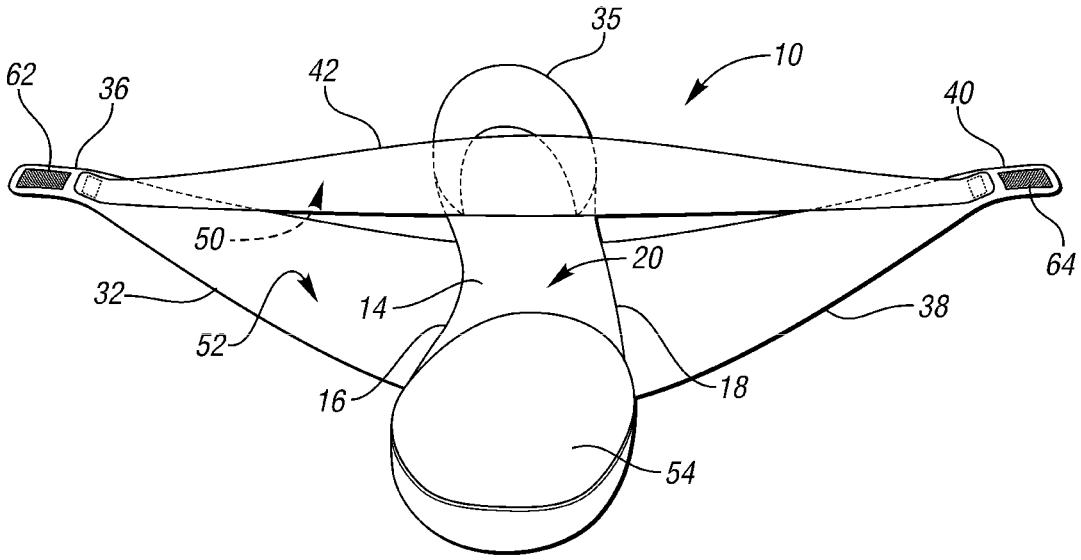
FIG. 2 is a schematic illustration in perspective view of the article of footwear of FIG. 1.
Figure 3:
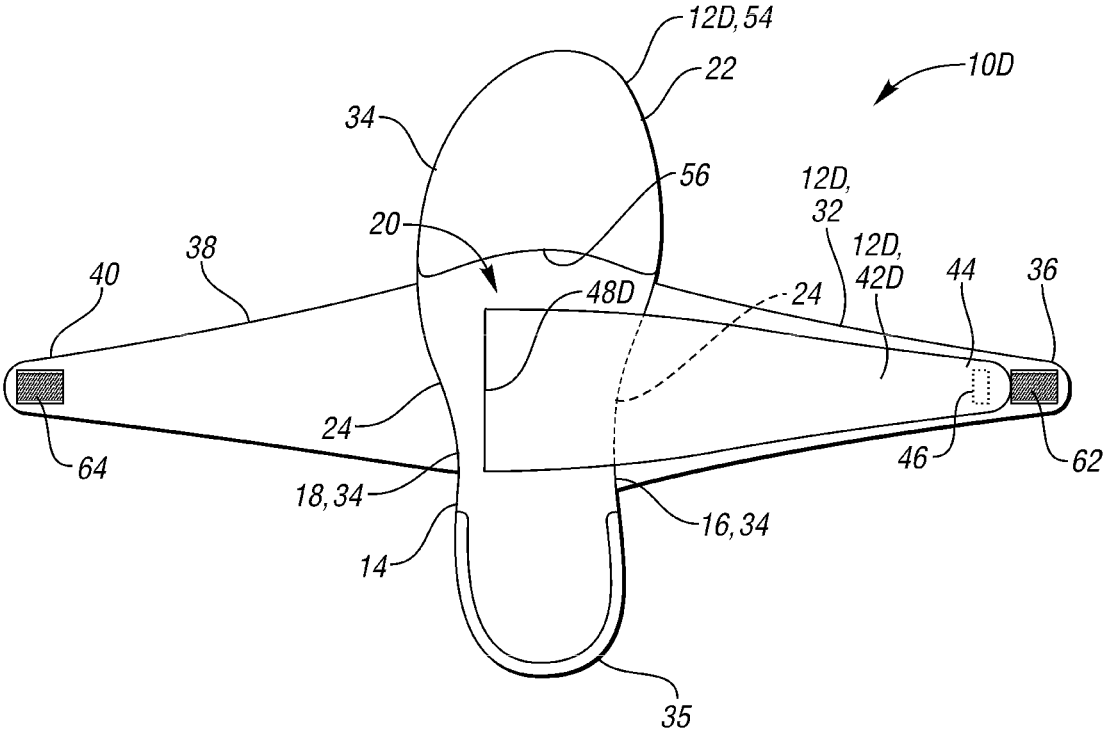
FIG. 3 is a schematic illustration in plan view of a second embodiment of an article of footwear in accordance with an alternative aspect of the present teachings.

The support member 42 also has a second end 48 fixed to the lateral side portion 38 remote from the lateral side 18 of the sole 14, such that the support member 42 spans across the sole 14 without connection to the sole 14, as best shown in FIG. 2. In the embodiment shown, the support member 42 spans generally laterally across the sole 14. The support member 42 is fixed only at the first end 44 and the second end 48. In FIG. 2, the first distal end 36 of the medial side portion 32 is shown lifted, and the second distal end 40 of the lateral side portion 38 is shown lifted. This lifts the support member 42, and illustrates that the support member 42 spans across and over the foot-receiving surface 20 of the sole 14, without connection to the sole 14. In other words, no part of the support member 42 is directly connected to the sole 14.

An outer surface 50 of the support member 42 is not in contact with the foot 28 when the foot 28 is placed on the foot-receiving surface 20 and on the support member 42, nor when the medial side portion 32 and the lateral side portion 38 are wrapped partially around the foot 28 and secured as described herein. The outer surface 50 is facing generally downward in FIG. 2. The outer surface 50 faces an inner surface 52 of the medial side portion 32. When the first distal end 36 of the medial side portion 32 is secured to the article of footwear 10, wrapping the medial side portion 32 at least partially around the foot 28 as described herein, the outer surface 50 will be in contact with the inner surface 52.

In addition to the medial side portion 32, the lateral side portion 38, and the support member 42, the upper 12 further includes a forefoot cover portion 54 secured to a periphery 34 of the sole 14 at the forefoot portion 22 and having an open side 56. When the foot 28 is placed on the foot-receiving surface 20, the forefoot is slipped under the forefoot cover portion 54 at the open side 56. Other configurations of the upper 12 may be used to secure the foot 28 at the forefoot portion 22. For example, one or more straps secured at either end to the periphery 34 at the forefoot portion 22 and spanning across the sole 14 at the forefoot portion 22 may be used in lieu of a forefoot cover portion 54.

The upper 12 also includes a heel member 35 that extends generally upward from the periphery 34 at the heel portion 26 of the sole 14. The heel member 35 is configured to surround a heel portion of the foot 28 as shown in FIGS. 5 and 6.

The lateral side portion 38, the medial side portion 32, and the support member 42 may be generally flexible, and generally flat fabric materials. For example, in some embodiments, the lateral side portion 38, the medial side portion 32, and the support member 42 may be a woven or knitted fabric or textile, or may be rubber or leather. The heel member 35 may optionally be less flexible than the lateral side portion 38, the medial side portion 32, and the support member 42 in order to provide greater support around the heel of the foot 28.

As such, the medial side portion 32 and the lateral side portion 38 are configured to wrap at least partially around a wearer's foot 28 positioned on the foot-receiving surface 20 and on the support member 42. Because the support member 42 is secured at the first end 44 and at the second end 48 to the medial side portion 32 and the lateral side portion 38, respectively, the support member 42 also wraps at least partially around the foot 28.

As shown in FIGS. 5 and 6, the foot 28 is placed on the foot-receiving surface 20 shown in FIG. 1 and on the support member 42. The forefoot portion of the foot 28 is placed within the optional forefoot cover portion 54 secured to the sole 14. The medial side portion 32 is wrapped over the foot 28 and back toward the heel portion 26 on the lateral side of the article of footwear 10 (i.e., near the lateral side 18 of the sole 14), where the first distal end 36 is securable to the heel member 35 of the article of footwear 10 proximal to the lateral side 18. Similarly, the second distal end 40 of the lateral side portion 38 is separately securable to the article of footwear 10 proximal to the medial side 16 when the medial side portion 32 and the lateral side portion 38 are separately wrapped at least partially around the foot. Stated differently, the first distal end 36 is securable to the heel member 35 nearer to the lateral side 18 than the medial side 16, and the second distal end 40 is separately securable to the heel member 35 nearer to the medial side 16 than to the lateral side 18. Additionally, the first distal end 36 is securable to the heel member 35 posterior to the lateral side portion 38, and the second distal end 40 is securable to the heel member 35 posterior to the medial side portion 32. The first distal end 36 is not secured to the lateral side portion 38, and the second distal end 40 is not secured to the medial side portion 32.

As shown in FIGS. 5 and 6, the lateral side portion 38 is wrapped over the foot 28, crossing over and resting on top of the medial side portion 32, and is secured to the heel member 35 on the medial side 16 of the article of footwear 10 (i.e., near the medial side 16 of the sole 14). Alternatively, the lateral side portion 38 can be wrapped partially around the foot 28 and secured prior to wrapping and securing the medial side portion 32, so that the medial side portion 32 crosses over and rests on top of the lateral side portion 38.

More specifically, with reference to FIG. 5, in the embodiment shown, the medial side portion 32 is secured to the heel member 35 of the upper 12 using a first embodiment of a fastening system 60. Any of various fastening systems with non-lacing fastening components can be used to secure the medial side portion 32 and the lateral side portion 38 to the article of footwear 10 separately from one another. For example, in the embodiment of FIGS. 1, 2, 5, and 6, the fastening system 60 includes a first fastener portion 62 fixed to the first distal end 36 of the medial side portion 32, and a second fastener portion 64 fixed to the second distal end 40 of the lateral side portion 38. The first fastener portion 62 and the second fastener portion 64 are fixed to the first distal end 36 and the second distal end 40 with stitching. Alternatively, the fastener portions 62, 64 can be bonded or adhered to the medial side portion 32 and the lateral side portion 38. The fastening system 60 also includes a third fastener portion 66 fixed to the heel member 35, such as by stitching, bonding, or adhesive.

The first fastener portion 62 and the second fastener portion 64 are securable to the third fastener portion 66 when the medial side portion 32 and the lateral side portion 38 are wrapped at least partially around the foot 28 as described. For example, in one non-limiting example, the fastening system 60 is a hook-and-loop fastening system, in which the first fastener portion 62 and the second fastener portion 64 are each a material that includes a plurality of hooks and the third fastener portion 66 is a material that includes a plurality of loops that are selectively and removably securable to the plurality of hooks. Alternatively, the first fastener portion 62 and second fastener portion 64 may each be a plurality of loops, and the third fastener portion 66 may be a plurality of hooks. Suitable material with hooks and loops for the hook and loop fastening system 60 is available from 3M Corporation at 3M Center, St. Paul, Minnesota under the trade name VELCRO™.

The third fastener portion 66 extends over the majority of the heel member 35, and is much larger than the first and the second fastener portions 62, 64. This allows each of the first and the second fastener portions 62, 64 to be secured at a variety of positions on the heel member 35 as desired, adjusting the tightness and fit of the first and second fastener portions 62, 64 to the foot 28. Alternatively, multiple discreet fastener portions of the material of the third fastener portion 66 could be positioned on the heel member 35, each providing a different positioning option for securing the first and second fastening portions 62, 64 to provide an adjustable fit.

Securing the medial side portion 32 and the lateral side portion 38 with any of the fastening portions described herein secures the article of footwear 10 to the foot 28, and no laces, ties, or other components are needed to secure the article of footwear 10 to the foot 28 and maintain the article of footwear 10 on the foot 28 during wear.

As best shown in FIG. 1, the medial side portion 32 tapers in width from the medial side 16 of the sole 14 to the first distal end 36. Similarly, the lateral side portion 38 tapers in width from the lateral side 18 of the sole 14 to the second distal end 40. The support member 42 is wider over the foot-receiving surface 20 than at the first end 44 and the second end 48, generally tapering toward the ends 44, 48. The tapered shape of the medial side portion 32, the lateral side portion 38, and the support member 42 facilitates wrapping the portions 32, 38 around the foot 28 without the portions 32, 38, or the support member 42 gaping away from the foot 28.

Optionally, the support member 42 may have a first elasticity, and the medial side portion 32 may have a second elasticity different than the first elasticity. For example, the first elasticity may be more or less than the second elasticity. If the first elasticity is greater than the second elasticity, this enables the support member 42 to wrap more snugly around the midfoot portion of the foot 28 when the medial side portion 32 and the lateral side portion 38 are secured to the heel member 35. For example, the support member 42 may be a shorter length shown in FIG. 2 when in an unstretched, relaxed state. When a foot 28 is placed on the support member 42 and the foot-receiving surface 20, and the medial side portion 32 and the lateral side portion 38 are wrapped around the foot 28 and secured as shown in FIGS. 5 and 6, the support member 42 is stretched relative to the relaxed state of FIG. 2, but due to its elasticity is biased to return to its relaxed state, causing it to fit snugly to the foot 28. By securing the distal ends 36, 40 in any selected location on the heel member 35 via the fastening system 60, the snugness of the support member 42 and the medial and lateral side portions 32, 38 around the foot 28 is variable and customizable.

Figure 11:
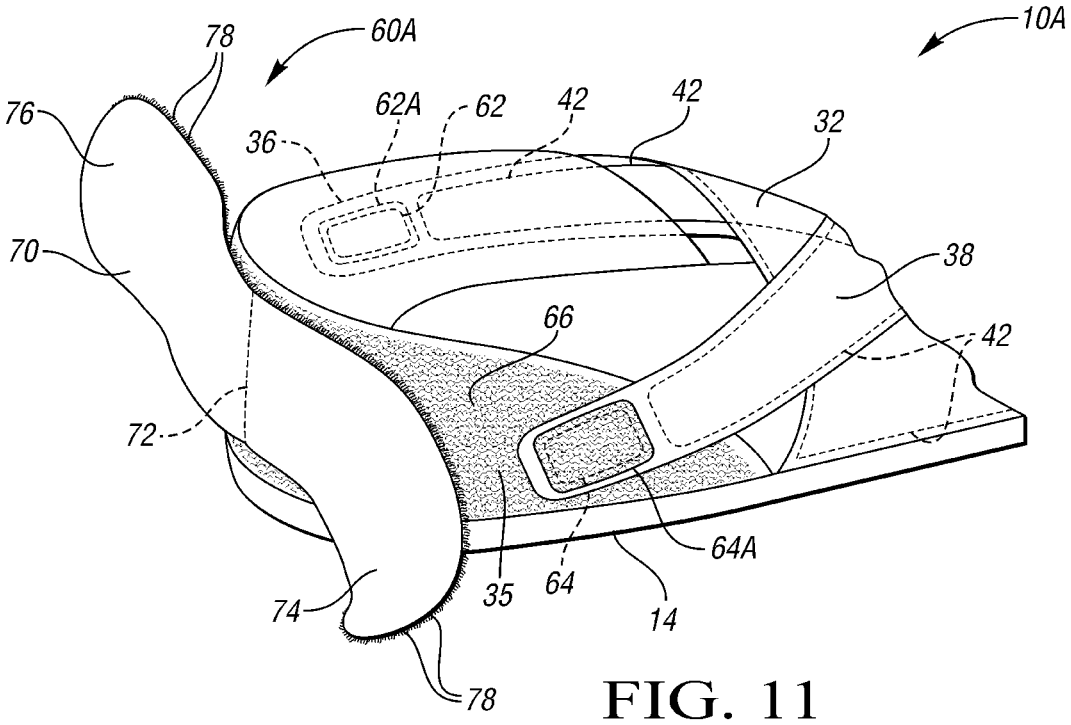
FIG. 11 is a schematic illustration in fragmentary perspective view of a heel portion of a fourth embodiment of an article of footwear with a second embodiment of a fastening system including a cover.
Figure 12:
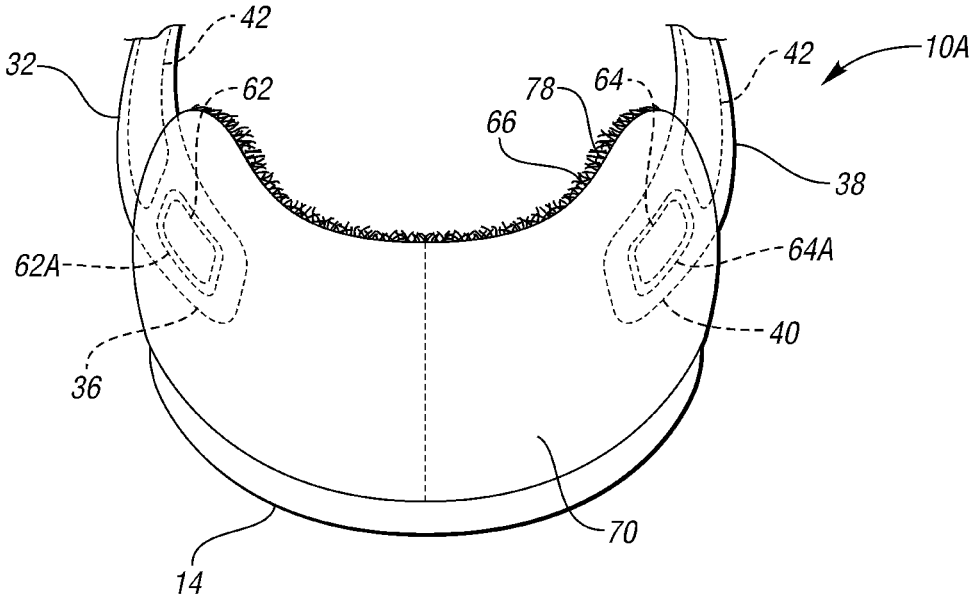
FIG. 12 is a schematic illustration in fragmentary perspective view of the heel portion of the article of footwear of FIG. 11 with the cover secured.

FIGS. 11 and 12 show an alternative embodiment of an article of footwear 10A identical to the article of footwear 10 except with a fastening system 60A that includes additional fastener portions 62A and 64A fixed to the opposite surface of the medial and lateral side portions 32, 38 than the first and second fastener portions 62, 64, respectively. As shown in FIG. 11, the fastening portions 62A, 64A face outward, and are exposed when the first and second fastening portions 62, 64 are secured to the third fastening portion 66. The fastening portions 62A, 64A can be hook or loop material, and the third fastener portion 66 can be hook material if the fastening portions 62A, 64A are loop material, or can be loop material if the fastening portions 62A, 64A are loop material.

The fastening system 60A further includes a cover 70 fixed to the heel member 35. In FIG. 11, the cover 70 is fixed to the heel member 35 with generally vertical stitching 72 at a central portion of the cover 70, creating a medial flap portion 74 and a lateral flap portion 76. An inner side 78 of the cover 70 facing the third fastener portion 66 has hook or loop material that is the same as the hooks or loops of the first and second fastener portions 62, 64. After the first and second distal ends 36, 40 are secured to the heel member 35, the medial flap portion 74 and the lateral flap portion 76 are pressed against the heel member 35 so that the inner side 78 secures to the third fastener portion 66, and extends over and also secures to the additional fastener portions 62A, 64A. This helps to further secure the medial and lateral side portions 32, 38 in the selected positions on the heel member 35.

Figure 13:
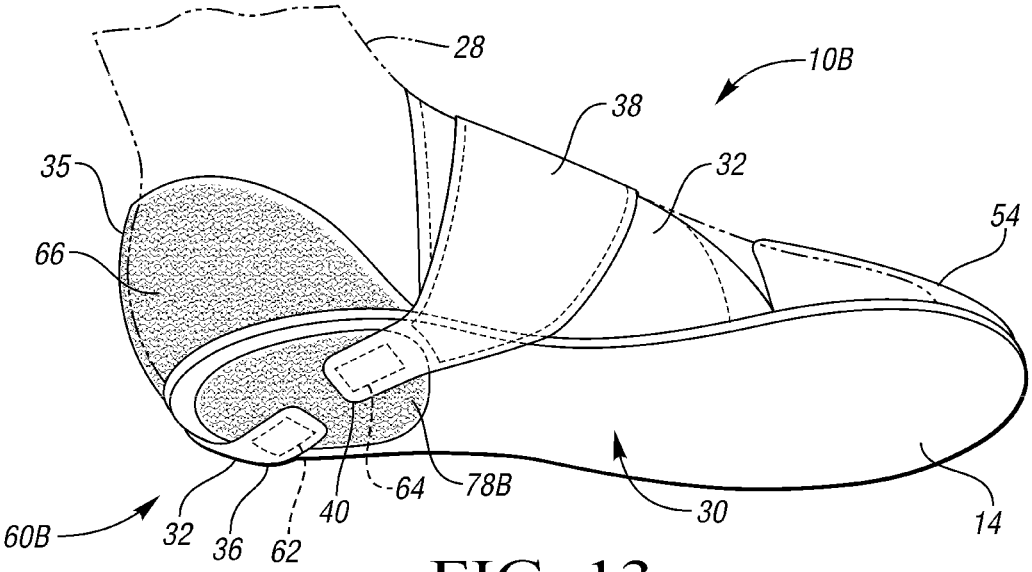
FIG. 13 is a schematic illustration in fragmentary perspective view of a fifth embodiment of an article of footwear with a third embodiment of a fastening system.

FIG. 13 shows an alternative embodiment of an article of footwear 10B identical to the article of footwear 10 except with a fastening system 60B that includes an additional fastener portion 78B fixed to the ground-contact surface 30. The additional fastener portion 78B has hooks or loops that can secure to the hooks or loops of the first and second fastener portions 62, 64. The first and second distal ends 36, 40 can be secured to the additional fastener portion 78B when the medial side portion 32 and the lateral side portion 38 are wrapped at least partially around the foot 28. The additional fastener portion 78B can be provided in addition to the third fastener portion 66, as shown in FIG. 13. Accordingly, the wearer has the option of securing one or both of the first and second fastener portions 62, 64 to the third fastener portion 66, and one or both of the first and second fastener portions 62, 64 to the additional fastener portion 78B. Optionally, the article of footwear 10B could be provided with the additional fastener portion 78B and without the third fastener portion 66.

Figure 14:
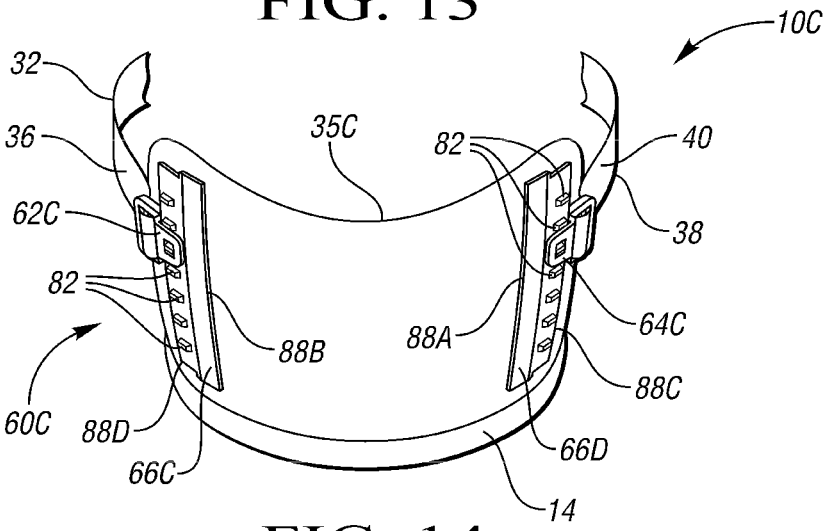
FIG. 14 is a schematic illustration in fragmentary rear view of a sixth embodiment of an article of footwear with a fourth embodiment of a fastening system.

FIG. 14 shows a heel portion 35C of an alternative embodiment of an article of footwear 10C1 identical to the article of footwear 10 except with a fastening system 60C. The fastening system 60C includes a first fastener portion 62C fixed to the first distal end 36 of the medial side portion 32, and a second fastener portion 64C fixed to a second distal end 40 of the lateral side portion 38. The first fastener portion 62C and the second fastener portion 64C are substantially identical to one another. Additional fastener portions 66C, 66D, which are substantially identical to one another, are fixed to the heel member 35C. Each of the additional fastener portions 66C, 66D may also be referred to as a third fastener portion. The fastener portions 62C, 64C, 66C, and 66D are available from NIFCO America Corporation, Costa Mesa, California.

Figure 15:
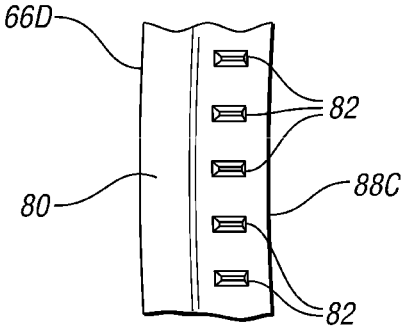
FIG. 15 is a schematic illustration in fragmentary side view of a first side of a portion of the fastening system of FIG. 14.
Figure 16:
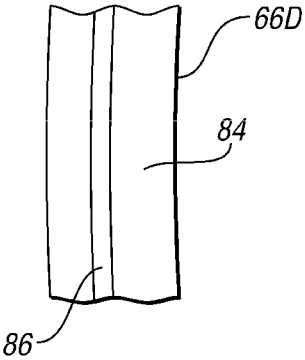
FIG. 16 is a schematic illustration in fragmentary side view of a second side of the portion of the fastening system of FIG. 15.

The additional fastener portion 66D is shown in greater detail in FIGS. 15 and 16. The additional fastener portion 66D has parallel slots 79 separated by a post 81. The lateral side portion 38 is threaded through the slots 79 around the post 81 and stitched or otherwise secured to itself to secure the fastener portion 64C to the lateral side portion 38. The medial side portion 32 is similarly secured to the fastener portion 62C.

Figure 17:
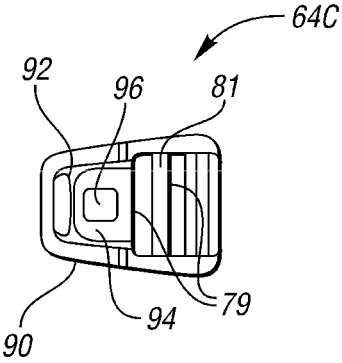
FIG. 17 is a schematic illustration in side view of another portion of the fastening system of FIG. 14.

The additional fastener portion 66D has a first side 80 with multiple spaced protrusions 82, as shown in FIG. 15. The additional fastener portion 66D also has a second side 84 with a groove 86, as shown in FIG. 16. In FIG. 14, each fastener portion 66C, 66D is secured to the heel member 35 so that the second side 84 is against the heel member 35 and the first side 80 is exposed. The fastener portions 66C, 66D are secured to the heel member 35 near edges 88A, 88B so that edges 88C and 88D, respectively, proximal to the protrusions 82 and the groove 86 can be lifted away from the heel member 35. This allows the first and second fastener portions 62C, 64C to slip around the edge 88C or 88D, respectively, and secure to one of the protrusions 82 while nesting in the groove 86. More specifically, with reference to FIG. 17, the first and second fastener portions 62C, 64C each have an extension 90 that has a tab 92 that fits within the groove 86. Each of the first and second fastener portions 62C, 64C also has a clasp 94 with an opening 96 that slips over the selected protrusion 82 to clip the first or second fastener portion 62C, 64C to the fastener portion 66C, 66D, respectively, thereby securing the fastener portion 62C or 64C to the additional fastener portion 66C or 66D at the selected protrusion 82. The clasp 94 is flexible relative to the extension 90, so that the first or second fastener portion 62C or 64C can be removed from the fastener portion 66C or 66D by lifting the clasp 94 off of the protrusion 82, and then lifting the respective fastener portion 62C, 64C away from the heel member 35 to pull the tab 92 out of the groove 86.

Figure 18:
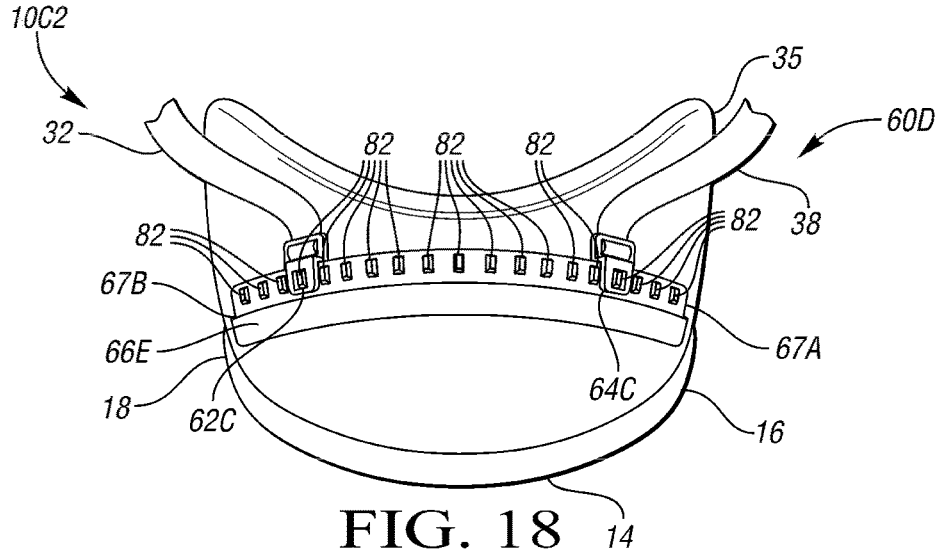
FIG. 18 is a schematic illustration in fragmentary rear view of a seventh embodiment of an article of footwear with a fifth embodiment of a fastening system.

Alternatively, in another embodiment of an article of footwear 10C2 shown in FIG. 18, an alternative embodiment of a fastening system 60D has only a single fastener portion 66E similar to fastener portion 66C or 66D fixed to the heel member 35 so that it extends on the heel member 35 from an end 67A near the sole 14 on the medial side 16 to an end 67B near the sole 14 on the lateral side 18, arcing upward on the heel member 35 between the ends 67A, 67B. In such an embodiment, each of the first and second fastener portions 62C, 64C can be secured to a different selected one of the protrusions 82.

Figure 19:
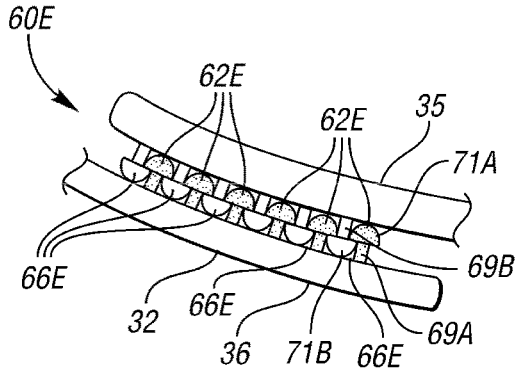
FIG. 19 is a schematic illustration in fragmentary side view of a sixth embodiment of a fastening system shown on the article of footwear of FIG. 1.

FIG. 19 shows a portion of an alternative embodiment of a fastening system 60E that is a mechanical interlocking fastening system including a first fastener portion 62E fixed to the first distal end 36 of the medial side portion 32, and a third fastener portion 66E fixed to the heel member 35. A second fastener portion, not shown, is substantially identical to the first fastener portion 62E and is secured to the lateral side portion 38 at the second distal end 40.

The first fastener portion 62E includes an array of spaced stems 69A with enlarged ends 71A, and the third fastener portion 66E includes an array of spaced stems 69B with enlarged ends 71B. Only one row of the stems 69A and one row of the stems 69B are shown in FIG. 19. Additional rows of the stems 69A with enlarged ends 71A are spaced adjacent the row shown, and additional rows of the stems 69B with enlarged ends 71B are spaced adjacent the row shown such that each fastener portion 62E, 66E is an array of stems with enlarged ends.

The enlarged ends 71A, 71B are larger in width than the respective stems 69A, 69B. For example, in an embodiment in which the stems 69A, 69B are cylindrical and the enlarged ends 71A, 71B are portions of spheres, the radius of each enlarged end 71A is greater than the radius of each stem 69A, and the radius of each enlarged end 71B is greater than the radius of each stem 69B. In the embodiment shown, each of the enlarged ends 71A, 71B is a segment of a sphere. In other embodiments, the enlarged ends 71A, 71B and the stems 69A, 69B could have other shapes.

The enlarged ends 71A of the first fastener portion 62E as well as the substantially identical enlarged ends of the second fastener portion (not shown) interlock with the enlarged ends 71B of the third fastener portion 66E when pushed against the third fastener portion 66E. The first fastener portion 62E is releasably interlocked with the third fastener portion 66E in FIG. 19. For example, the enlarged ends 71A of the first fastener portion 62E can be released from the enlarged ends 71B of the third fastener portion 66E by peeling the first end 36 away from the heel member 35. The stems 69A, and the stems 69B can be spaced to have a desired density. For example, the fastener portions 62E, 66E are available from 3M Corporation at 3M Center, St. Paul, Minnesota, under the trade name DUAL LOCK RECLOSABLE FASTENERS™.

Figure 20:
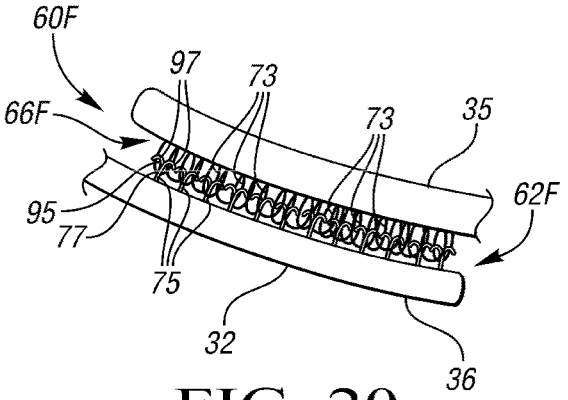
FIG. 20 is a schematic illustration in fragmentary side view of a seventh embodiment of a fastening system shown on the article of footwear of FIG. 1.

FIG. 20 shows another alternative embodiment of a fastening system 60F that is a hook and loop fastening system including a first fastener portion 62F fixed to the first distal end 36 of the medial side portion 32, and a third fastener portion 66F fixed to the heel member 35. A second fastener portion, not shown, is substantially identical to the first fastener portion 62F and is secured to the lateral side portion 38 at the second distal end 40. As shown, the third fastener portion 66F includes a plurality of loops 73, and the first fastener portion 62F includes a plurality of hooks 75. Each of the hooks 75 has a stem 77 with a double-pronged end 95. Each double-pronged end 95 has two prongs 97 extending in different directions, such as opposite directions. The prongs 97 are also referred to as hook portions. The two prongs 97 of each stem 77 help to firmly secure the first fastener portion 62F to the third fastener portion 66F. The double-pronged ends 95 may better secure the first fastener portion 62F to the third fastener portion 66F under shear loading than a plurality of hooks each having only a single hooked end. Suitable material with hooks and loops for the hook and loop fastener system 60F or for any of the other hook and loop fastener systems described herein is available from 3M Corporation at 3M Center, St. Paul, Minnesota under the trade name VELCRO™.

Figure 21:
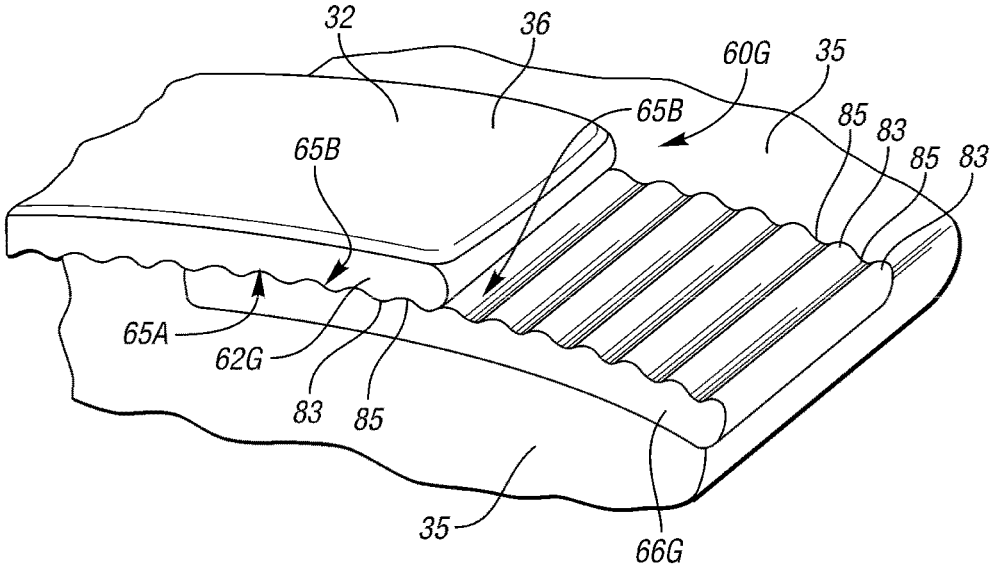
FIG. 21 is a schematic illustration in fragmentary perspective view of an eighth embodiment of a fastening system shown on the article of footwear of FIG. 1.

In any of the embodiments of footwear shown and described herein, a fastening system that includes magnets fixed to the medial and lateral side portions 32, 38, and magnets secured to the heel member 35 or elsewhere on the article of footwear to which the magnets on the medial side portion 32 and on the lateral side portion 38 can be selectively and releasably secured. For example, in FIG. 21, a fastening system 60G is a magnetic fastening system that includes a first fastener portion 62G fixed to the first distal end 36 of the medial side portion 32, and a third fastener portion 66G fixed to the heel member 35. A second fastener portion (not shown) similar to the first fastener portion 62G is fixed to the lateral side portion 38. The fastener portions 62G, 66G are fixed to the medial side portion 32 and to the heel member 35 respectively by adhesives or otherwise. The fastener portions 62G, 66G have surfaces 65A, 65B, respectively, that contact one another when the medial side portion 32 is wrapped at least partially around the foot 28. The surfaces 65A, 65B have mutually nesting, uniformly spaced protuberances 83 and indentations 85. The fastener portions 62G, 66G, and the second fastener portion (not shown) also include a permanently magnetizable material, magnetized with rows of alternating poles so that the first fastener portion 62G and the third fastener portion 66G will be magnetically held to one another when the first fastener portion 62G is placed against the third fastener portion 66G with the protuberances 83 of the first fastener portion 62G nested in the indentations 85 of the third fastener portion 66G. As is evident in FIG. 21, the position of the first fastener portion 62G on the third fastener portion 66G can be adjusted by aligning the protuberances 83 of the first fastener portion 62G with a different set of the indentations 85 of the third fastener portion 66G. The position of the second fastener portion (not shown) is similarly adjustable. Other embodiments of magnetic fastening systems may be used, such as any of those shown in U.S. Pat. No. 4,941,236 to Sherman et al., which is hereby incorporated by reference in its entirety.

Figure 4:
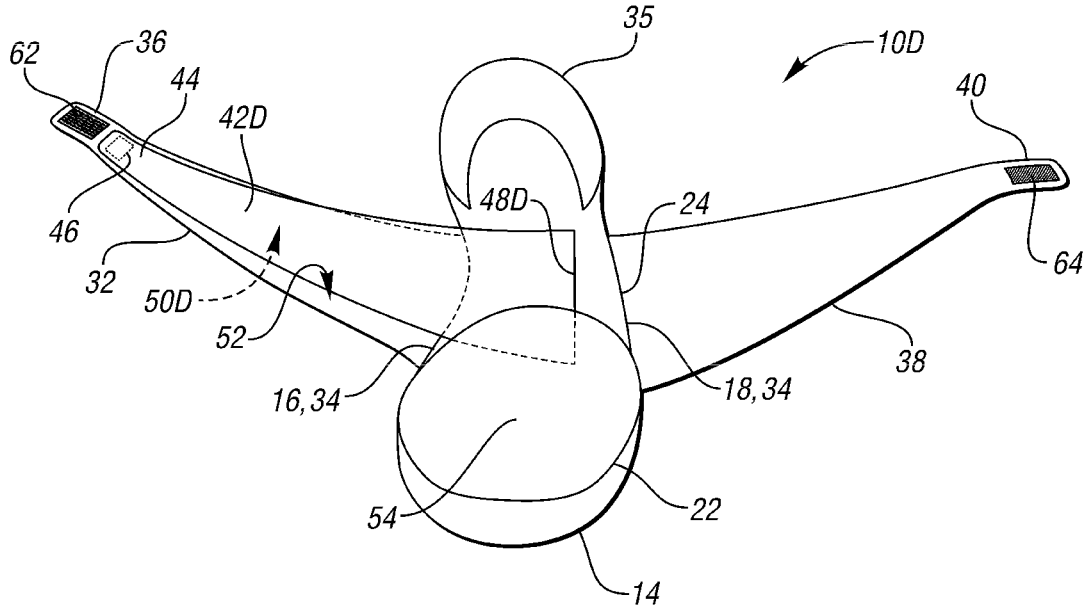
FIG. 4 is a schematic illustration in perspective view of the article of footwear of FIG. 3.

An alternative embodiment of an article of footwear 10D with an alternative upper 12D is shown in FIGS. 3-4, 9-10. The article of footwear 10D is identical to the article of footwear 10 except that the upper 12D has a support member 42D in lieu of support member 42. The support member 42D has a second end 48D fixed to the foot-receiving surface 20 of the sole 14 between the medial side 16 and the lateral side 18. In other words, the second end 48D is not fixed to the periphery 34 of the sole 14. As such, the support member 42D spans only partway across the sole 14 above the foot-receiving surface 20 at the midfoot portion 24 of the sole 14. For example, the second end 48D can be fixed to the sole 14 by stitching, adhesives, or bonding. The first end 44 of the support member 42D is fixed to the first distal end 36 of the medial side portion 32, just as with the support member 42. The support member 42D is fixed only at the first end 44 and at the second end 48D, as best shown in FIG. 4. Thus, between the second end 48D and the medial side 16, the support member 42D can lift away from the foot-receiving surface 20 at the midfoot portion of the foot 28 when the medial side portion 32 is wrapped at least partially around the foot 28. When the medial side portion 32 and the lateral side portion 38 are secured to the article of footwear 10D with the first distal end 36 proximal to the lateral side 18 and the second distal end 40 proximal to the medial side 16, the support member 42D lifts and supports the midfoot portion of the foot 28, e.g., such as the navicular joint.

An outer surface 50D of the support member 42D is a surface that is not in contact with the foot 28 when the foot 28 is placed on the foot-receiving surface 20 and on the support member 42D, nor when the support member 42D is wrapped at least partially around the foot 28. The outer surface 50D is facing generally downward in FIG. 2. The outer surface 50D faces an inner surface 52 of the medial side portion 32. When the first distal end 36 of the medial side portion 32 is secured to the article of footwear 10D, wrapping the medial side portion 32 at least partially around the foot 28 as described herein, the outer surface 50D will be in contact with the inner surface 52.

The support member 42D is wider at the foot-receiving surface 20 (i.e., near the second end 48D) than at the first end 44, tapering in width from the second end 48D to the first end 44. Additionally, the medial side portion 32 may have a first elasticity, and the support member 42D may have a second elasticity different from the first elasticity. In other words, the support member 42D may be more or less elastic than the medial side portion 32 to affect the snugness of the support member 42D around the foot 28, as discussed with respect to support member 42.

Figure 9:
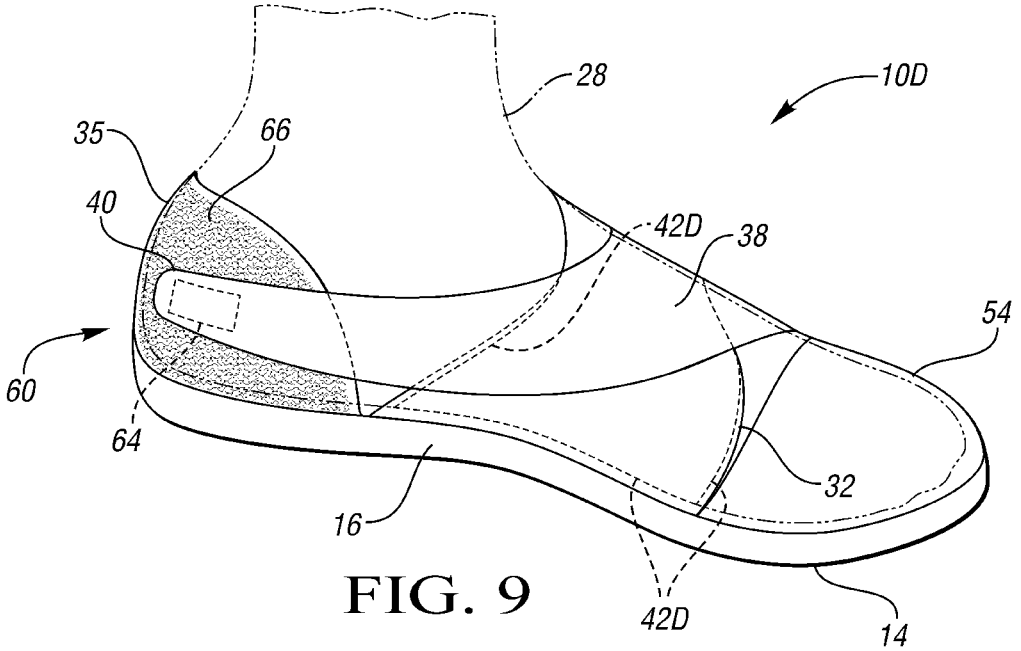
FIG. 9 is a schematic illustration in perspective view of the medial side of the article of footwear of FIG. 3.
Figure 10:
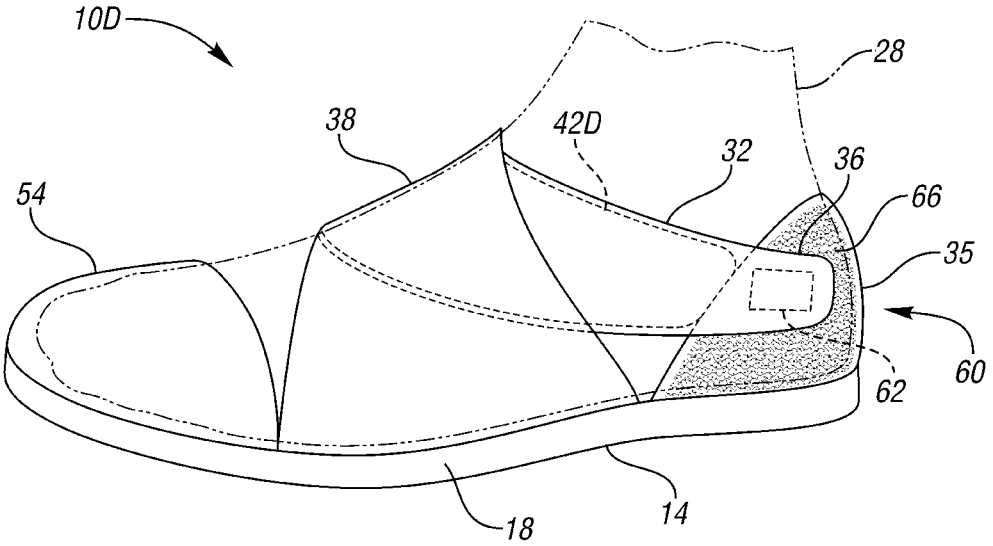
FIG. 10 is a schematic illustration in side view of the lateral side of the article of footwear of FIG. 3.

The article of footwear 10D can include any of a variety of fastening systems, such as but not limited to any of the fastening systems 60, 60A, 60B, 60C, 60D, 60E, 60F, 60G described herein. FIGS. 9 and 10 show the fastening system 60 used to secure the medial side portion 32 and the lateral side portion 38 of the article of footwear 10D, as discussed with respect to the article of footwear 10.

Figure 7:
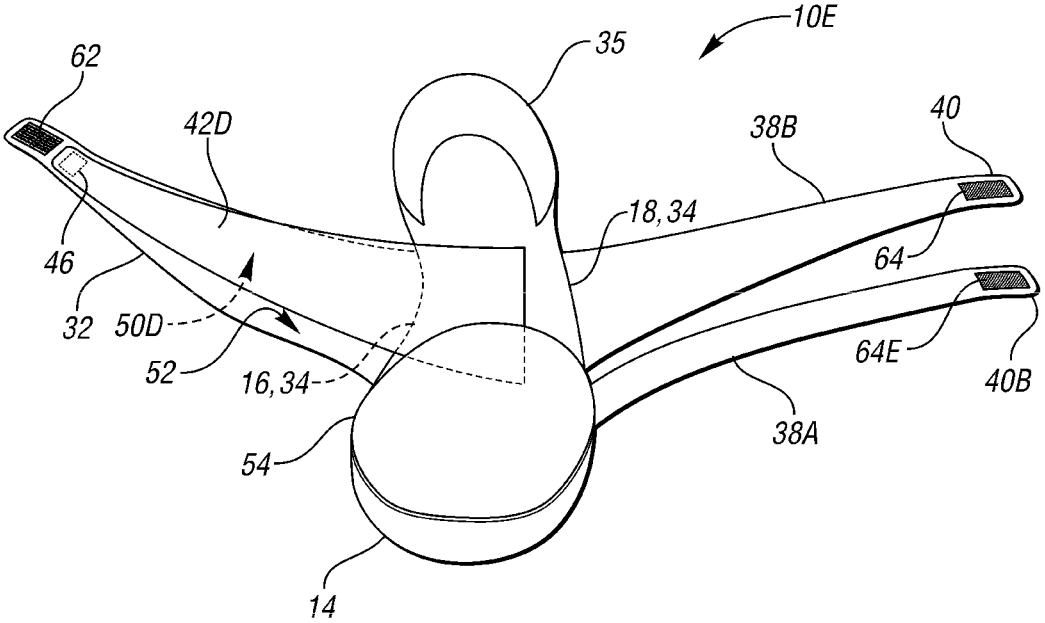
FIG. 7 is a schematic illustration in perspective view of a third embodiment of an article of footwear in accordance with an alternative aspect of the present teachings.
Figure 8:
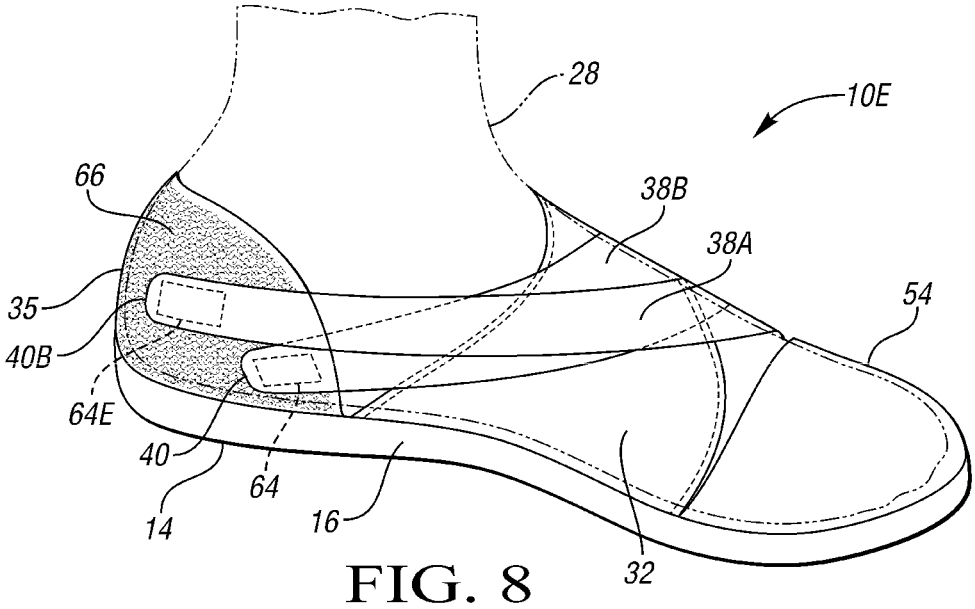
FIG. 8 is a schematic illustration in perspective view of the medial side of the article of footwear of FIG. 7.

Another alternative embodiment of an article of footwear 10E is shown in FIGS. 7-8. The article of footwear 10E is identical to the article of footwear 10D except that a lateral side portion 38A, 38B includes a first strap 38A secured to and extending from the periphery 34 of the sole 14 at the lateral side 18, and further includes a second strap 38B secured to and extending from the periphery 34 of the sole 14 at the lateral side 18 rearward of the first strap 38A. The second end 40 and the second fastener portion 64 are on the second strap 38B. The first strap 38A has an additional free end 40B securable to the article of footwear 10E separately from both the medial side portion 32 and the second strap 38B, as shown in FIG. 8. An additional fastener 64E is fixed to the end 40B of the first strap 38A. In the embodiment shown, the second strap 38B is wider than the first strap 38A. The narrower first strap 38A can more easily be wrapped at least partially around the foot 28 and secured to the third fastening portion 66 rearward of the end 40B. Optionally, the first and second straps 38A, 38B could be the same width, or the first strap 38A could be wider than the second strap 38B.

In FIG. 8, the medial side portion 32 is wrapped over the foot 28 toward the lateral side 18 and secured to the third fastener portion 66 (i.e., at the lateral side 18 not visible in FIG. 8). Next, the second strap 38B is wrapped over the foot 28 toward the medial side 16 and secured to the third fastener portion 66. Finally, the first strap 38A is wrapped over the foot 28 toward the medial side 16 and secured to the third fastener portion 66. Optionally, any other order of wrapping and securing the medial side portion 32 and the first and second straps 38A, 38B could instead be used. The article of footwear 10E can include any of the fastening systems 60, 60A, 60B, 60C, 60D, 60E, 60F, 60G described herein. FIGS. 7 and 8 show the fastening system 60, along with the additional fastener portion 64E.

FIGS. 22 and 23 show an alternative embodiment of an article of footwear 110A that has many of the same components as the article of footwear 10. The article of footwear includes a sole 114 having a medial side 116, a lateral side 118, and a foot-receiving surface 120. The article of footwear 110A also includes an upper 112 having a medial side portion 132 extending from the medial side 116 of the sole 114. The medial side portion 132 has a first distal end 136 remote from the medial side 116. The upper 112 also has a lateral side portion 138 extending from the lateral side 118 of the sole 114. The lateral side portion 138 has a second distal end 140 remote from the lateral side 118. In FIG. 22, the medial side portion 132 and the lateral side portion 138 are shown extended outward, prior to wrapping at least partially around the foot 28 shown in FIG. 23A and being secured to the article of footwear 110, such as to a heel member 135 similarly as described with respect to heel member 35. The upper 112 also has a front portion 122 extending between the medial side portion 132 and the lateral side portion 138.

The article of footwear 110A further includes a strobel portion 139 extending between the medial side portion 132 and the lateral side portion 138 and secured to the foot-receiving surface 120. The strobel portion 139 can be configured to cover the entire foot-receiving surface 120, or only a portion of the foot-receiving surface 120.

As best shown in FIG. 23A, the medial side portion 132, the lateral side portion 138, the front portion 122, and the strobel portion 139 define a pocket 141 configured to receive the foot 28. Additionally, the medial side portion 132, the lateral side portion 138, the front portion 122, and the strobel portion 139 are integrally formed as a contiguous, unitary component from a plurality of strands of the same material or different materials such as fabrics or textiles that may be yarns, filaments, etc. Stated differently, stitching need not be used to secure the medial side portion 132, the lateral side portion 138, the front portion 122, and the strobel portion 139 together, and instead these portions are made integral by at least one of knitting, weaving, or braiding one or more types of strands of material in a continuous manner, allowing the pocket 141 to be seamless.

Optionally, as shown in FIGS. 23A-23D, the medial side portion 132 may include multiple layers of the same or different materials. For example, the medial side portion 132 may include a first layer 150A with a plurality of knitted strands 151 shown in detail in FIG. 23C, such as yarns which can be fibers. The medial side portion 132 may also include a second layer 152A with a plurality of strands 153 (shown in detail in FIG. 23D), such as woven textile strands, which may be filaments. A phantom line 154 indicates generally the interface of the layers 150A, 152A where the strands 151 of the first layer 150A are integrally formed with the strands 153 of the second layer 152A. Although only two layers are shown, additional layers, such as six layers, can be integrally formed. The lateral side portion 138 includes first and second layers 150B, 152B similar to layers 150A, 152B, respectively. The strobel portion 139 can be the same plurality of strands 153 integrally and contiguously extending to the lateral side portion 138. The front portion 122 can be strands 155 shown in detail in FIG. 23B, such as woven textile strands formed in a different woven configuration than the woven strands 153, but still integral and contiguous with the layers 150A, 150B. Additional fabrics or materials can also be integrally knitted, woven or braided in different functional areas of the article of footwear 110A to provide various functions. For example, in FIG. 22, an area 160 of the front portion 122 is configured of the knitted yarns integrally and contiguously formed with the woven textile strands 155 in order to provide increased breathability and flexibility above the forefoot.

Similar to the article of footwear 10, the medial side portion 132 and the lateral side portion 138 are configured to wrap at least partially around the foot 28 positioned on the foot-receiving surface 120. The first distal end 136 is securable to the article of footwear 110A proximal to the lateral side 118 when the medial side portion 132 and the lateral side portion 138 are wrapped at least partially around the foot, such as to a heel member 135 identical in function to the heel member 35. The second distal end 140 is separately securable to the article of footwear 110A proximal to the medial side 116, such as to the heel member 135. Any of the fastening systems 60, 60A, 60B, 60C, 60D, 60E, 60F and 60G described herein can be used to secure the medial and lateral side portions 132, 138 to the article of footwear 110A as described. In the embodiment shown, the first and second fastener portions 62, 64 used in the article of footwear 10 are fixed to the medial side portion 132 and the lateral side portion 138. respectively, FIG. 24 shows another embodiment of an article of footwear 110B having many of the same features as the article of footwear 110A, as indicated with like reference numbers. The upper 112 further includes a support member 142 that extends at least partially across the foot-receiving surface 120 of the sole 114. The support member 142 has a first end 144 fixed to the medial side portion 132 remote from the medial side 116 of the sole 114. In other words, the first end 144 is secured to and integrally formed with the medial side portion 132, and is not secured to the medial side 116. In the embodiment shown, the first end 144 of the support member 142 is fixed to the medial side portion 132 by integral weaving with the medial side portion 132.

The support member 142 also has a second end 148 fixed to the sole 114 via the strobel portion 139A by integral weaving with the strobel portion 139A. In the embodiment shown, the support member 142 spans generally laterally across the sole 114 to the second end 148. The support member 142 is fixed only at the first end 144 and the second end 148.

An outer surface 150 of the support member 142 is not in contact with the foot 28 when the foot 28 is placed on the foot-receiving surface 120 and on the support member 142, nor when the medial side portion 132 and the lateral side portion 138 are wrapped partially around the foot 28 and secured as described herein. The outer surface 150 is facing generally downward in FIG. 24. An inner surface 156 of the support member 142 contacts the foot 28. When the first end 136 of the medial side portion 132 is secured to the article of footwear 110 by wrapping the medial side portion 132 at least partially around the foot 28, the midfoot portion of the foot 28, such as the navicular joint, is supported as described herein.

In FIG. 24, the medial side portion 132 and the lateral side portion 138 have a first woven configuration 155A indicated by paired strands 157A in the fore-aft direction. The front portion 122 and the strobel portion 139A have a different, second woven configuration 155B indicated by single strands 157B in the fore-aft direction. The support member 142 has a third woven configuration 155C also indicated by single strands 157C in the fore-aft direction, but different than the second woven configuration and the first woven configuration. For example, the strands 157C may be a different material or have a different thickness than the strands 157A and/or 157B so that the support member 142 is more or less elastic in comparison to the medial side portion 132 and the lateral side portion 138 and/or in comparison to the front portion 122.

Figure 25:
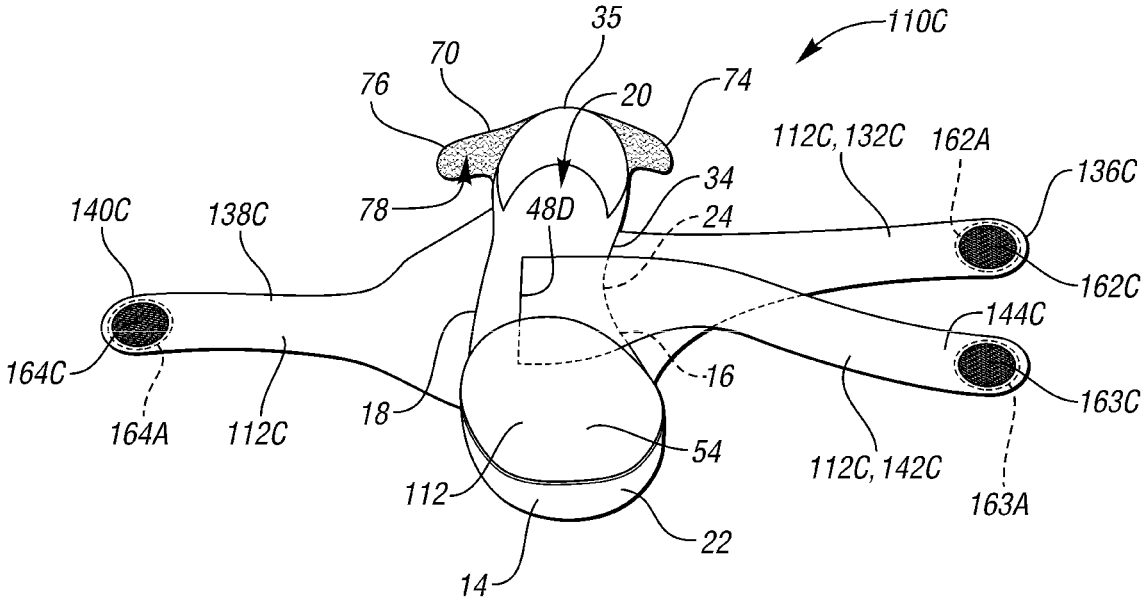
FIG. 25 is a schematic illustration in perspective view of a tenth embodiment of an article of footwear.
Figure 26:
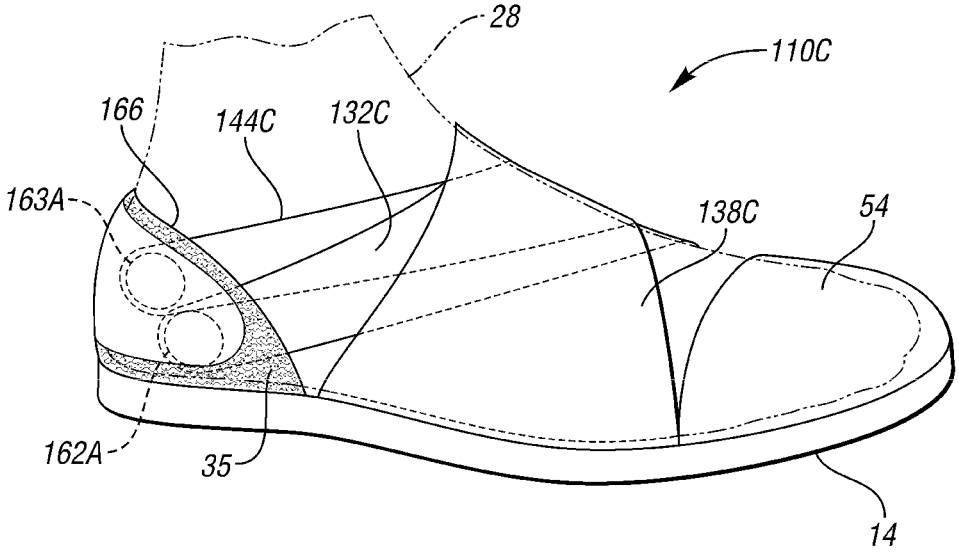
FIG. 26 is a schematic illustration in perspective view of the lateral side of the article of footwear of FIG. 25.

FIGS. 25 and 26 show a tenth embodiment of an article of footwear 110C. The article of footwear 110C has many of the same components that are referenced with identical reference numbers in FIGS. 25 and 26 and are as described with respect to FIGS. 3 and 4. The article of footwear 110C has an upper 112C with a medial portion 132C and a lateral portion 138C substantially similar to the medial portion 32 and the lateral portion 38. The article of footwear 110C differs from the article of footwear 10D in that it includes a support member 142C that is not secured at its distal end 144C to the medial portion 132C.

The support member 142C has a second end 48D fixed to the foot-receiving surface 20 of the sole 14 between the medial side 16 and the lateral side 18, as described with respect to the article of footwear 110C. The support member 142C is fixed only at the second end 48D, as best shown in FIG. 25. Thus, between the second end 48D and the medial side 16, the support member 42D can lift away from the foot-receiving surface 20 at the midfoot portion of the foot 28 when the support member 142C is wrapped at least partially around the foot 28 to lift and support the midfoot portion of the foot 28, e.g., such as the navicular joint. Because the distal end 144C is not fixed to the medial side portion 132C, the support member 142C can be wrapped partially around the foot 28 and secured to the heel member 35 separately from wrapping the medial portion 132C partially around the foot 28 and securing the medial portion 132C to the heel member 35. For example, the support member 142C can be at least partially wrapped around the foot 28 and secured to the heel member 35 prior to wrapping the medial portion 132C at least partially around the foot 28 and securing the medial portion 132C to the heel member 35. Because it is separately secured to the heel member 35, the support member 142C also has a fastener portion 163C secured near its distal end 144C. The medial side portion 132C and the lateral side portion 138C also each have a fastener portion 162C, 164C secured near their respective distal ends 136C, 140C, as shown in FIG. 25.

Accordingly, the support provided by the support member 142C and the medial side portion 132C can be tailored and customized by the wearer by securing the distal ends 144C, 136C at different locations on the heel member 35 as shown in FIG. 26.

The support member 142C is wider at the foot-receiving surface 20 (i.e., near the second end 48D) than at the first end 144C, tapering in width from the second end 48D to the first end 144C. The medial side portion 132C and the lateral side portion 138C also taper in width to their respective ends 136C, 140C. The tapered shape of the medial side portion 132C, the lateral side portion 138C, and the support member 142C facilitates wrapping the portions 132C, 138C around the foot 28 without the portions 132C, 138C, or the support member 142C gaping away from the foot 28.

Additionally, the medial side portion 132C may have a first elasticity, and the support member 142C may have a second elasticity different from the first elasticity. In other words, the support member 142C may be more or less elastic than the medial side portion 132C to affect the snugness of the support member 142C around the foot 28, as discussed with respect to support member 42.

The article of footwear 110C can include any of a variety of fastening systems, such as but not limited to any of the fastening systems 60, 60A, 60B, 60C, 60D, 60E, 60F, 60G described herein. FIGS. 25 and 26 show a fastening system 160C similar to the fastening system 60A of FIG. 11. Additional fastener portions 162A and 164A are fixed to the opposite surface of the medial and lateral side portions 132C, 138C than the first and second fastener portions 162C, 164C, respectively. A fastener portion 163A is also fixed to the opposite surface of the medial support portion 142C than the fastener portion 163C. The fastening portions 162A, 164A, 163A face outward, and are exposed when the first and second fastening portions 162C, 164C and fastening portion 163C are secured to a third fastening portion 166 that is positioned on and secured to the heel member 35.

The fastening system 160C further includes a cover 70 fixed to the heel member 35. The cover 70 is fixed to the heel member 35 with generally vertical stitching 72 at a central portion of the cover 70, creating a medial flap portion 74 and a lateral flap portion 76, as shown in FIGS. 11 and 25. An inner side 78 of the cover 70 facing the third fastener portion 166 has hook or loop material that is the same as the hooks or loops of the fastener portions 162A, 163A, and 164A. After the distal ends 136C, 140C, and 144C are secured to the heel member 35 via the fastener members 162C, 163C, and 164C, the medial flap portion 74 and the lateral flap portion 76 are pressed against the heel member 35 so that the inner side 78 secures to the third fastener portion 166, and extends over and also secures to the additional fastener portions 162A, 163A, 164A. This helps to further secure the medial and lateral side portions 132, 138 and the support member 142C in the selected positions on the heel member 35.

Figure 27:
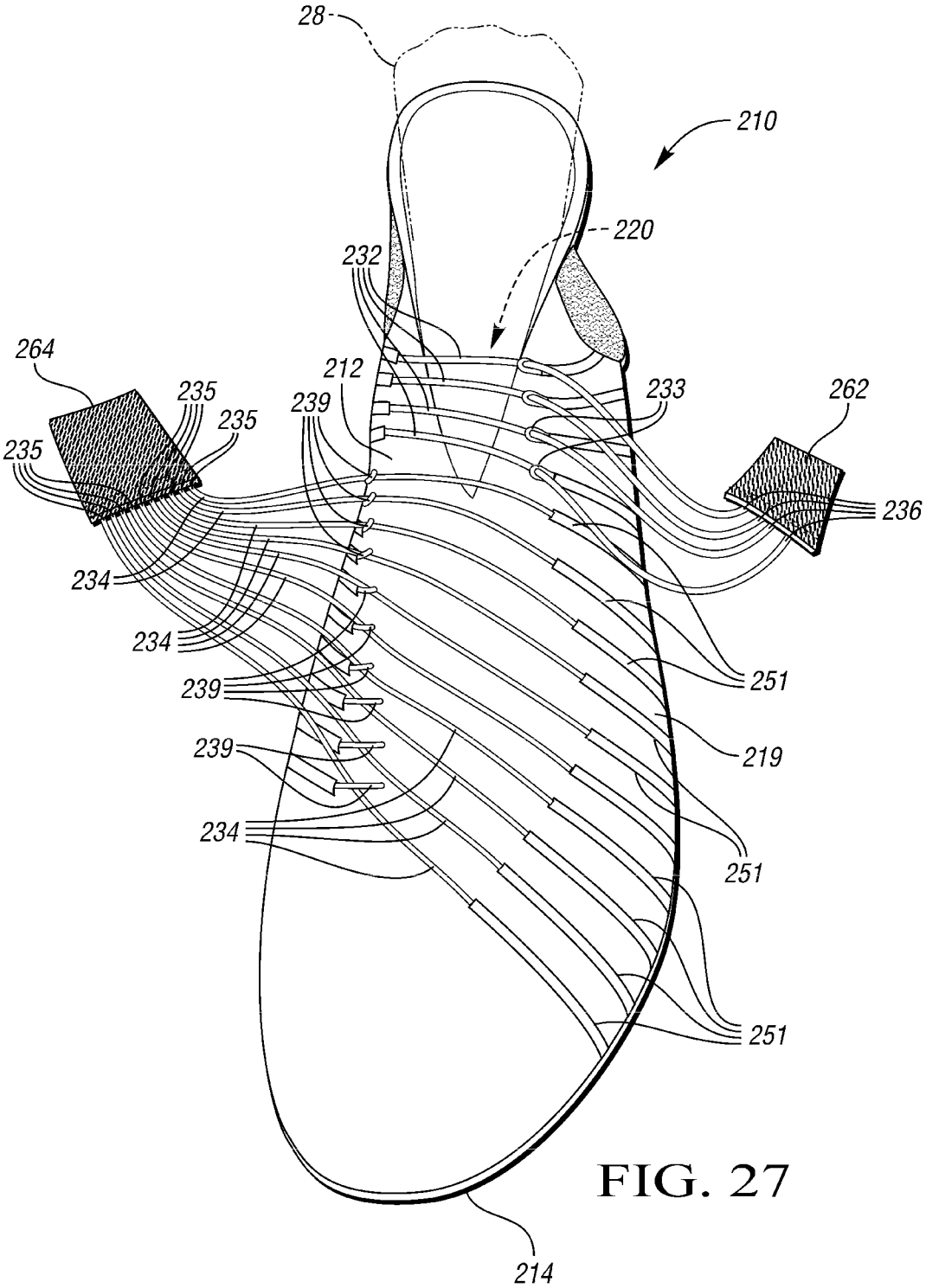
FIG. 27 is a schematic illustration in perspective view of an eleventh embodiment of an article of footwear.
Figure 28:
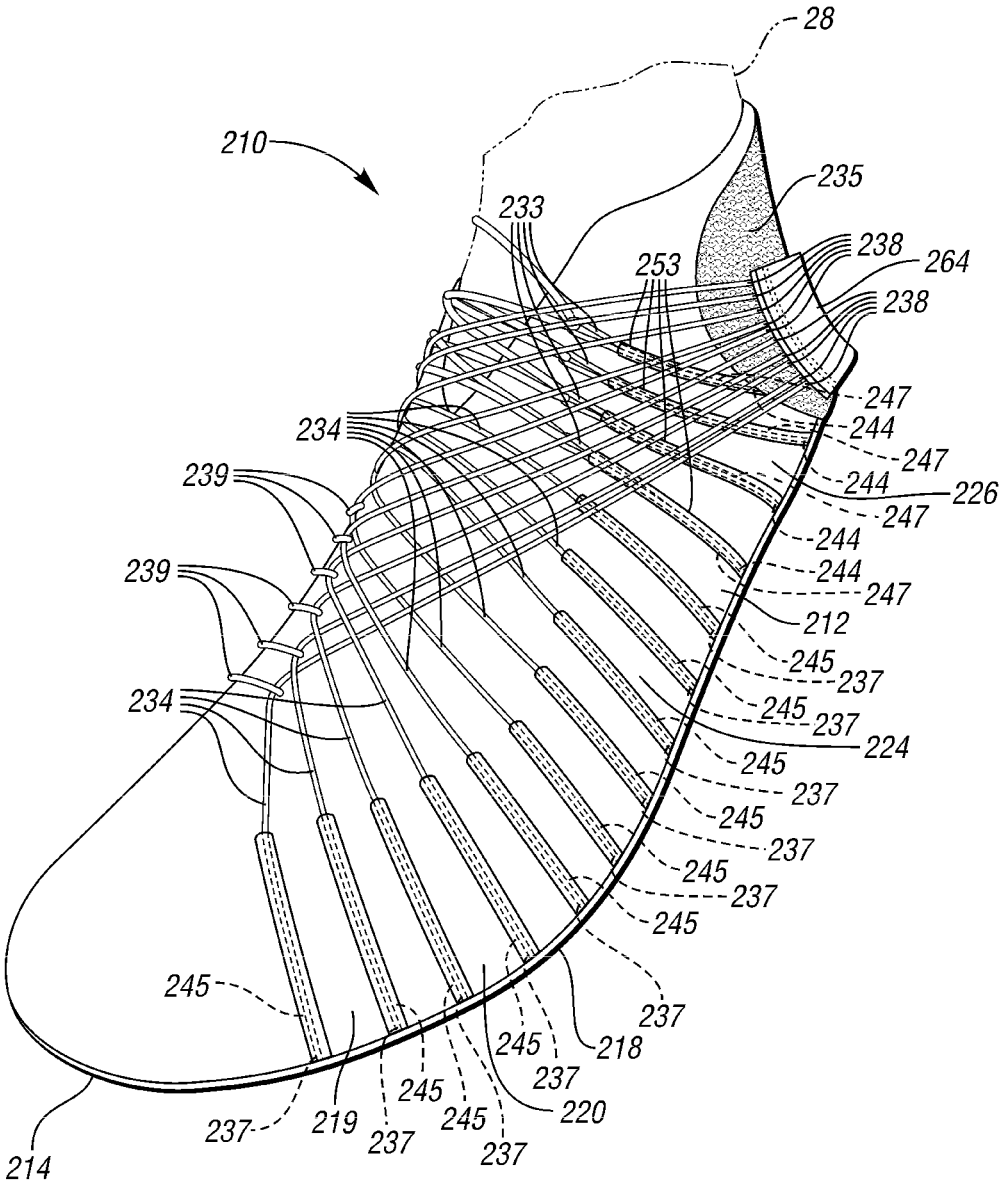
FIG. 28 is a schematic illustration in perspective view of a lateral side of the article of footwear of FIG. 27.
Figure 29:
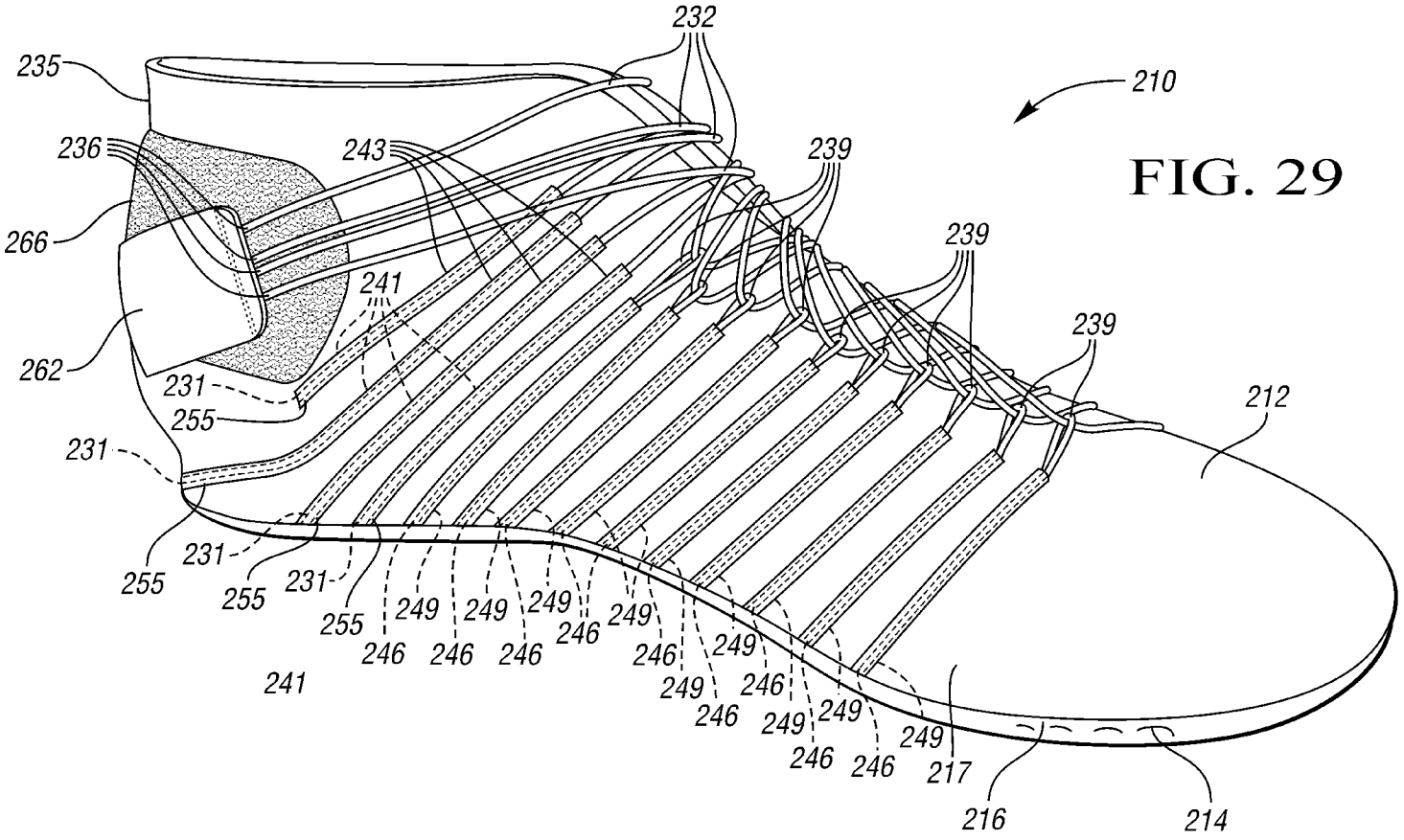
FIG. 29 is a schematic illustration in perspective view of a medial side of the article of footwear of FIG. 27.

FIGS. 27-29 show an alternative embodiment of an article of footwear 210. The article of footwear 210 has a sole 214 with a medial side 216, a lateral side 218, and a foot-receiving surface 220. The foot-receiving surface 220 is not visible in the views shown, but is similar to foot-receiving surface 20 and supports the foot 28 either directly or with a strobel unit or portion of the upper 212 under the foot 28 and between the foot 28 and the sole 214.

As shown, the article of footwear 210 is an athletic shoe, such as for track and field. The sole 214 may include any or all of an outsole, a midsole, and one or more fluid-filled or foam cushioning elements. The sole 214 may be equipped with spikes, cleats, or other ground-engaging members. In other embodiments, the article of footwear 210 could be for another category of footwear, such as a dress shoe, a work shoe, a sandal, a slipper, or a boot.

The article of footwear 210 also includes an upper 212 secured to the sole 214. The upper 212 can be a unitary, one-piece component, or can be multiple pieces, interconnected such as by stitching. In a non-limiting example, the upper 212 can be woven, knitted, or braided fibers, yarns, or other materials. The upper 212 has a medial side 217 and a lateral side 219, that are considered as opposite sides of the article of footwear 210. The upper 212 and the sole 214 together define a heel portion 226, a midfoot portion 224, and a forefoot portion 222 of the article of footwear 210. The medial side 217 and the lateral side 219 each extend from the heel portion 226 to the forefoot portion 222.

The article of footwear 210 uses a plurality of elongated cables 232, 234, each of which originates on one side of the upper 212, extend through looped cables 233, 239 on the opposite side of the upper 212, and secures to the article of footwear 210 with a fastener portion 262, 264 at distal ends of the cables 232, 238 as described herein. In this manner, the plurality of cables 232 or 234 are grouped together by the fastener portion. Unlike the medial side portion 32 or the lateral side portion 38 of the upper 12 in other embodiments described herein, the elongated cables 232, 234 cross back to the same side of the upper 212 from which they originate (i.e., to which they are fixed at the proximal ends) when fastened as described herein. The upper 212 is selectively tightened on a wearer's foot by adjustment of the position of a fastener portion 262, 264 on the upper 212, and tension provided by force of the cables 232, 234 on the looped cables 233, 239. The cables 232, 233, 234, and 239 may have a relatively high tensile modulus so that they do not stretch along their length during tensioning of the cables and attachment of the fastener portions 262, 264 to a heel member 235 that includes a heel fastener 266. For example, the cables 232, 233, 234, and 239 may be a polyester or nylon material. In some embodiments, the cables 232, 233, 234, and 239 may be a webbing integrally formed with the remainder of the upper 212.

More specifically, the article of footwear 210 includes a plurality of first cables 232. Each has a proximal end 231 fixed to the lateral side of the upper as indicated with hidden lines in FIG. 29. Each of the first cables 232 also has a distal end 236. The first cables 232 are generally elongated, and each have a length from the proximal end 231 to the distal end 236 many times greater than a width of the first cable 232. In the embodiment shown, each first cable 232 is generally cylindrical in cross-section, but could have other cross-sectional shapes.

A first fastener portion 262 is secured to the distal end 236 of each of the plurality of first cables and is selectively fastenable to the upper 212. The distal end 236 is remote from the upper 212 when the first fastener portion 262 is not secured to the upper 212, as shown in FIG. 27. In other words, when the first fastener portion 262 is only suspended from the upper 212 by the first cables 232, but is not fastened to a fastener portion 266 provided on the upper 212, the distal ends 236 can hang with the first fastener portion 262 remotely apart from the upper 212.

The article of footwear 210 includes a plurality of first looped cables 233 that extend in an array on the lateral side 219 of the upper 212. Each one of the plurality of first cables 232 extends through a respective one of the plurality of first looped cables 233 between the proximal end 231 and the distal end 236. The securement of the distal ends 236 to the first fastener portion 262 retains the first cables 232 through the first looped cables 233 even when the first fastener portion 262 is not secured to the upper 212. Due to the looped cables 233, the elongated first cables 232 are able to double back to the medial side 217 of the upper 212 as shown in FIG. 29, extending along the medial side 217 between the plurality of first looped cables 233 and the first fastener portion 262 fastened to the upper 212.

More specifically, the article of footwear 210 includes a heel member 235 which may be an integral portion of the upper 212 at the heel portion 226 of the upper 212. A heel fastener 266 is secured to the heel member 235. The first fastener portion 262 and the heel fastener 266 can utilize any of the fastening systems shown and described herein. In the embodiment shown, the fastener portions are hook-and-loop type fastener portions. For example, the heel fastener portion 266 may be a plurality of loops, and the first fastener portion 262 may include a plurality of hooks that secure to the loops when placed in contact with the loops. The placement of the first fastener portion 262 on the heel fastener portion 266 adjusts the tension in the first cables 232 and the force that the first cables 232 exert on the first looped cables 233. For example, the heel fastener portion 266 is large enough so that the first fastener portion 262 can be placed higher, lower, more forward, or more rearward on the heel fastener to adjust the tension and the direction of forces on the upper due to the tightened first cables 232 extending through the first looped cables 233.

Portions of the first cables 232 and the first looped cables 233 are maintained in specific positions relative to the upper 212 in order to partially control the forces applied on the upper 212. More specifically, the upper 212 defines elongated first channels 241 on the medial side 217, as best shown in FIG. 29. Each of the first channels 241 encloses a respective one of the plurality of first cables 232 from the proximal end 231 partway to the plurality of first looped cables 233. The first cables 232 are fixed relative to the upper only at their proximal ends 231, and are otherwise able to move within the confines of the first channels 241. The portions of the first cables 232 within the first channels 241 are indicated with hidden lines in FIG. 29. The first channels 241 are generally parallel with one another, and function to generally position and aim the first cables 232 toward the array of first looped cables 233. The first channels 241 may be integrally formed in the upper 212 by a knit or weave of the upper 212 that separates outer and inner layers of the upper 212 at the channels 241. Alternatively, a discrete outer cover layer or layers may be secured to a base layer of the upper 212 to define the first channels 241 between the cover layer and the base layer. In either embodiment, the outer portion 243 of the upper 212 at the first channels 241 is indicated in FIG. 29.

In addition to the first cables 232 and first looped cables 233, the article of footwear 210 also has a plurality of second cables 234 each having a proximal end 237 fixed to the lateral side 219 of the upper 212, and a distal end 238 that is selectively remote from the upper 212.

A plurality of second looped cables 239 extend in an array on the medial side 217 of the upper 212. Each one of the plurality of second cables 234 extends through a respective one of the plurality of second looped cables 239 between the proximal end 237 and the distal end 238. The second cables 234 extend along the lateral side 219 of the upper 212 between the plurality of second looped cables 239 and the second fastener 264 when the second fastener 264 is fastened to the upper 212.

The second cables 234 can be selectively secured to the upper 212 via a second fastener portion 264 that is secured to the distal ends 238 and can fasten to the heel fastener portion 266. As with the first fastener portion 262, the second fastener portion 264 and the heel fastener portion 266 can utilize any of the fastening systems shown and described herein. In the embodiment shown, the fastener portions 264, 266 are hook-and-loop type fasteners. For example, the heel fastener portion 266 may be a plurality of loops, and the second fastener 264 may include a plurality of hooks that secure to the loops when placed in contact with the loops. The placement of the first fastener portion 264 on the heel fastener portion 266 adjusts the tension in the second cables 234 and the force that the second cables 234 exert on the second looped cables 239. For example, the heel fastener portion 266 is large enough so that the second fastener portion 264 can be placed higher, lower, more forward, or more rearward on the heel fastener to adjust the tension and the direction of forces on the upper due to the tightened second cables 234 extending through the second looped cables 239. Securing the first cables 232 and the second cables 234 with any of the fastening portions described herein secures the article of footwear 210 to the foot 28, and no laces, ties, or other components are needed to secure the article of footwear 310 to the foot 28 and maintain the article of footwear 310 on the foot 28 during wear. The total width of the spaced first cables 232 and second cables 234 tapers from the fixed proximal ends to the respective fastener portions 262, 264, which facilitates wrapping the cables 232, 234 around the foot 28 without the cables 232, 234 gaping away from the foot 28.

The proximal ends 231, 237, 244, and 246 of the first and second cables 232, 234, and of the looped cables 233, 239, respectively, can be secured to the upper 212 by fusing, stitching, or otherwise. For example, the proximal ends 231, 237, 244, and 246 could be sandwiched between the upper 212 and the sole 214 to secure the proximal ends 231, 237, 244, and 246 to the upper 212 when the sole 214 is attached to the upper 212.

The proximal ends 231, 237, 244, and 246 of the first and second cables 232, 234, and of the looped cables 233, 239, respectively, can be secured to the upper 212 near their terminal ends, but not necessarily at or only at their terminal ends. Similarly, the distal ends 236, 238 of the first and second cables 232, 234, respectively can be secured to the fastener portions 262, 264 near their terminal ends but not necessarily at or only at their terminal ends.

Additionally, the medial side 217 of the upper 212 defines elongated second channels 241. Each of the second channels 241 encloses a respective one of the plurality of second cables 234 from the proximal end 237 partway to the plurality of second looped cables 239. Stated differently, the second channels 245 do not extend completely to the second looped cables 239. Because of this, only a portion of the second cables 234 are housed within the second channels 245, and a portion is exposed between the second channels 245 and the second looped cables 239 as best shown in FIG. 28. The exposed portions have greater mobility relative to the upper 212 during positioning of the second fastener portion 264 on the heel fastener portion 266, and thus contribute to the customizable fit of the upper 212 via the cables 232, 234 and fastener portions 262, 264, 266. The second channels 245 are generally parallel with one another or at least do not intersect one another, and function to generally position and aim the second cables 234 toward the array of second looped cables 239. The second channels 245 may be integrally formed in the upper 212 by a knit or weave of the upper 212 that separates outer and inner layers of the upper 212 at the channels 245. Alternatively, a discrete outer cover layer or layers may be secured to a base layer of the upper to define the second channels 245 between the cover layer and the base layer. In either embodiment, the outer portion 251 of the upper 212 at the second channels 245 is indicated in FIG. 27.

The looped cables 232, 234 are also partially housed in elongated channels defined by the upper 212. More specifically, the lateral side 219 of the upper 212 defines elongated third channels 247, and the first looped cables 233 are partially housed in and extend out from the third channels 247. The medial side 217 of the upper 212 defines elongated fourth channels 249 shown in FIG. 29, and the second looped cables 239 are partially housed in and extend out from the fourth channels 249. Similar to the first and second elongated cables 232, 234, proximal ends 244 of the first looped cables 233 are secured to the upper 212 near the sole 214 at the lateral side 219 as shown in FIG. 28, and proximal ends 246 of the second looped cables 239 are secured to the upper 212 near the sole 214 at the medial side 217 as shown in FIG. 29.

As with the first and second channels 241, 245, the third channels 247 and the fourth channels 249 may be integrally formed in the upper 212 by a knit or weave of the upper 212 that separates outer and inner layers of the upper 212 at the channels 247, 249. Alternatively, a discrete outer cover layer or layers may be secured to a base layer of the upper 212 to define the channels 247, 249 between the cover layer and the base layer. In either embodiment, the outer portion 253 of the upper 212 at the third channels 247 is indicated in FIG. 28, and the outer portion 255 of the upper 212 at the fourth channels 249 is indicated in FIG. 29.

As is most apparent in FIG. 29, the plurality of second looped cables 239 are on the medial side 217 of the upper 212, and the proximal end 231 of each one of the plurality of first cables 232 is fixed to the medial side 217 of the upper 212 rearward of the plurality of second looped cables 239. With reference to FIG. 28, the plurality of first looped cables 233 are on the lateral side 219 of the upper 212, and the proximal end 237 of each one of the plurality of second cables 234 is fixed to the lateral side 219 of the upper 212 forward of the plurality of first looped cables 233. The third and fourth channels 247, 249 position the first and second looped cables 233, 239 in arrays that extend generally fore and aft along the upper 212. The third and fourth channels 247, 249 are generally equally spaced, and the looped cables 233, 239 are spaced generally evenly apart from one another due to the third and fourth channels 247, 249.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative only and not as limiting.

The invention claimed is:

1. An article of footwear comprising:

a sole having a medial side, a lateral side, and a foot-receiving surface;

an upper having:

a medial side portion extending from the medial side of the sole; and a lateral side portion extending from the lateral side of the sole and having a distal end remote from the lateral side; and a strobel portion extending over the foot-receiving surface of the sole;

wherein:

the medial side portion is configured to extend at least partially over an instep of a foot positioned on the foot-receiving surface;

the lateral side portion is configured to wrap over the medial side portion at the instep;

the distal end is securable to the upper proximal to the medial side of the sole when the lateral side portion is wrapped over the medial side portion; and the lateral side portion and the strobel portion are a contiguous, unitary component of a plurality of strands of the same material or of different materials.

2. The article of footwear of claim 1, wherein the lateral side portion establishes a midfoot region of the article of footwear at the lateral side of the sole and extends at least a length of the midfoot region of the article of footwear at the lateral side of the sole.

3. The article of footwear of claim 2, wherein the lateral side portion is configured as a strap; and the article of footwear further comprising:

a fastener portion secured to an inner surface of the distal end of the lateral side portion; and an additional fastener portion secured to an outer surface of the upper, with the fastener portion securable to the additional fastener portion.

4. The article of footwear of claim 3, wherein:

the fastener portion comprises either a plurality of hooks or a plurality of loops securable to the plurality of hooks; and the additional fastener portion comprises the other of the plurality of hooks or the plurality of loops.

5. The article of footwear of claim 1, wherein the medial side portion and the lateral side portion are each a flexible material.

6. The article of footwear of claim 1, wherein the medial side portion and the lateral side portion each include a woven or knitted fabric or textile.

7. The article of footwear of claim 1, wherein:

the medial side portion includes a first layer and a second layer;

the first layer includes a first type of yarn; and the second layer includes a second type of yarn different than the first type of yarn.

8. The article of footwear of claim 7, wherein the first layer is integrally formed with the second layer.

9. The article of footwear of claim 7, wherein the first layer is at an inner side of the medial side portion and the second layer is at an outer side of the medial side portion.

10. The article of footwear of claim 7, wherein the second layer includes a knitted portion.

11. The article of footwear of claim 1, wherein the strobel portion covers the entire foot-receiving surface of the sole.

12. The article of footwear of claim 1, wherein the upper includes a front portion extending between the medial side portion and the lateral side portion; and wherein the medial side portion, the lateral side portion, the front portion, and the strobel portion define a pocket configured to receive a foot.

13. The article of footwear of claim 12, wherein the upper is knitted.

14. An article of footwear comprising:

a sole having a medial side, a lateral side, a front side, and a foot-receiving surface;

an upper having:

a medial side portion extending from the medial side of the sole;

a lateral side portion extending from the lateral side of the sole and having a distal end remote from the lateral side;

a front portion extending from the front side and positioned between the medial side portion and the lateral side portion; and a strobel portion disposed at the foot-receiving surface of the sole;

wherein:

the medial side portion, the lateral side portion, the front portion, and the strobel portion define a pocket configured to receive a foot;

the lateral side portion is configured to wrap over at least a part of the medial side portion;

the distal end is securable to the upper proximal to the medial side of the sole when the lateral side portion is wrapped over the medial side portion;

the lateral side portion has an anterior edge that begins at the strobel portion and a posterior edge that begins at the strobel portion; and the lateral side portion tapers in width between the anterior edge and the posterior edge from the sole to the distal end.

15. The article of footwear of claim 14, wherein an area of the front portion above a forefoot region of the pocket includes knitted yarns.

16. The article of footwear of claim 14, wherein the medial side portion is configured to extend at least partially over an instep of a foot positioned on the foot-receiving surface and received in the pocket.

17. The article of footwear of claim 14, wherein the strobel portion covers the entire foot-receiving surface of the sole.

18. The article of footwear of claim 14, wherein the medial side portion includes a first layer and a second layer.

19. The article of footwear of claim 18, wherein the first layer is integrally formed with the second layer.

* * * * *